US008567578B2

(12) United States Patent
Cuong et al.

(10) Patent No.: US 8,567,578 B2
(45) Date of Patent: Oct. 29, 2013

(54) PORTABLE COMPUTER CASE

(75) Inventors: Bui Phu Cuong, Westminster, CA (US); Todd Gormick, San Clemente, CA (US); Robert Shortt, San Clemente, CA (US)

(73) Assignee: Targus Group International, Inc., Anaheim, CA (US)

( * ) Notice: Subject to any disclaimer, the term of this patent is extended or adjusted under 35 U.S.C. 154(b) by 1076 days.

(21) Appl. No.: 12/370,824

(22) Filed: Feb. 13, 2009

(65) Prior Publication Data

US 2009/0229936 A1 Sep. 17, 2009

Related U.S. Application Data

(60) Provisional application No. 61/036,394, filed on Mar. 13, 2008, provisional application No. 61/053,468, filed on May 15, 2008.

(51) Int. Cl.
*B60R 7/00* (2006.01)

(52) U.S. Cl.
USPC ..... 190/107; 190/100; 190/109; 190/110; 190/117; 190/18 R; 206/316.1; 206/317; 206/320; 206/522; 206/586; D3/279; D3/283; D3/284; D3/285; D3/301

(58) Field of Classification Search
USPC ..... 190/107–111; 206/320; 224/580, 582, 224/607, 652, 653; D3/217, 276, 284, 285, D3/287, 289, 296, 299
See application file for complete search history.

(56) References Cited

U.S. PATENT DOCUMENTS

| | | | | |
|---|---|---|---|---|
| 910,619 | A | | 1/1909 | Weidemann |
| 1,046,843 | A | | 12/1912 | Olpp |
| 1,121,422 | A | * | 12/1914 | Tydings ..... 312/208.4 |
| 1,372,126 | A | | 3/1921 | Dunham, Jr. |

(Continued)

FOREIGN PATENT DOCUMENTS

| | | |
|---|---|---|
| DE | 4234581 | 4/1993 |
| EP | 797939 | 1/1997 |

(Continued)

OTHER PUBLICATIONS

Office Action for U.S. Appl. No. 10/939,333, filed Sep. 14, 2004, mailed Apr. 7, 2008 15 pgs.

(Continued)

*Primary Examiner* — Anthony Stashick
*Assistant Examiner* — Cynthia Collado
(74) *Attorney, Agent, or Firm* — John R. Thompson; Stoel Rives LLP

(57) ABSTRACT

A computer case having an open and a closed configuration may comprise two or more sections. The sections may be foldably joined. A fastener may selectively maintain the computer case in the closed configuration. One or more of the sections may be adapted to receive an electronic device, such as a computer. The sections adapted to receive a computer may comprise a cover. The computer case may be comprised of materials configured to allow the contents thereof to be scanned by a scanning device, such as an X-ray. Portions of the case may allow for visual inspection of a computer disposed therein. A foldable container may be disposed between foldable sections of the case. The foldable container may be configured to receive and hold personal items during a security screening process.

57 Claims, 16 Drawing Sheets

(56) References Cited

U.S. PATENT DOCUMENTS 1,374,126 A 4/1921 Walter
1,416,465 A 5/1922 Harvey
1,444,112 A 2/1923 Davis
1,556,352 A 10/1925 Ritter
1,658,174 A 2/1928 Russell
1,721,427 A 7/1929 Aldrich
1,826,976 A 10/1931 Wright
1,889,765 A 12/1932 Switkes
2,018,605 A 10/1935 Craig
2,083,029 A 6/1937 Lowy
2,110,163 A 3/1938 Lobel
2,170,841 A 8/1939 Thies et al.
2,187,587 A 11/1939 Plotkin
2,316,328 A 4/1943 Guenther et al.
2,335,779 A 11/1943 Mazzei
2,503,746 A 4/1950 Klehr
2,554,215 A * 5/1951 Schell et al. ..... 190/115
2,556,066 A * 6/1951 Cline ..... 190/111
2,574,146 A 11/1951 Gottesman
2,589,438 A 3/1952 Schneider
2,653,709 A 9/1953 Cunningham et al.
2,681,142 A 6/1954 Cohen
2,696,322 A 12/1954 Densen
2,700,460 A 1/1955 Hoover
2,700,518 A 1/1955 Ryno et al.
2,769,474 A 11/1956 Klotz
2,771,167 A 11/1956 Lifton
2,771,184 A 11/1956 Ryno et al.
2,785,795 A 3/1957 Ryno et al.
2,800,940 A 7/1957 Riesebeck
2,837,208 A 6/1958 Lingenfelter
2,908,362 A 10/1959 Burtchaell
2,913,080 A 11/1959 Louik et al.
D188,582 S 8/1960 Koffler
3,023,868 A 3/1962 Koffler
3,081,807 A 3/1963 Lightburn
3,115,228 A 12/1963 Louik et al.
3,115,229 A 12/1963 Erhard
3,136,413 A 6/1964 Hall
3,176,742 A 4/1965 Kubnick
3,185,198 A 5/1965 Bryan
3,192,978 A 7/1965 Horvath
3,265,168 A 8/1966 Erhard
3,286,751 A 11/1966 Dishart
3,292,778 A 12/1966 Enderle
3,412,521 A 11/1968 Bauman
3,441,072 A 4/1969 Schmitt
3,497,041 A 2/1970 SamHammer
3,500,973 A 3/1970 Bush
3,529,317 A 9/1970 Schwarzkopf
3,530,213 A 9/1970 Isle
3,531,822 A 10/1970 Bush
3,575,781 A 4/1971 Pezely
3,656,594 A 4/1972 Marks et al.
3,698,404 A 10/1972 Greco
3,752,301 A 8/1973 Bluemel
3,813,729 A 6/1974 Szabo et al.
3,853,220 A 12/1974 Luray
3,912,055 A 10/1975 Malooly
3,912,140 A 10/1975 Franges
3,944,033 A 3/1976 Simson
3,949,879 A 4/1976 Peterson et al.
4,013,170 A 3/1977 Hutterer
4,044,867 A 8/1977 Fisher
4,106,597 A 8/1978 Shook et al.
4,114,761 A 9/1978 Kleiner
4,117,933 A 10/1978 Lachance
4,141,401 A 2/1979 Hindemit
4,189,037 A 2/1980 Szabo
4,212,377 A 7/1980 Weinreb
4,213,520 A 7/1980 Sarna et al.
4,259,568 A 3/1981 Dynesen
4,261,078 A 4/1981 Edwards et al.
4,336,883 A 6/1982 Krug et al.
4,339,039 A 7/1982 Mykleby
4,340,990 A 7/1982 Seynhaeve
4,364,150 A 12/1982 Remington
4,378,866 A 4/1983 Pelavin
4,433,781 A 2/1984 Hummel
4,478,450 A 10/1984 Picozza
4,514,876 A 5/1985 Houlberg
4,569,082 A 2/1986 Ainsworth et al.
4,573,202 A 2/1986 Lee
4,620,633 A 11/1986 Lookholder
4,651,872 A 3/1987 Joyce
4,655,418 A 4/1987 Melahn
4,658,298 A 4/1987 Takeda et al.
4,664,254 A 5/1987 Sitwell et al.
4,685,571 A 8/1987 Hoss
4,703,161 A 10/1987 McLean
4,707,883 A 11/1987 Irani et al.
4,722,376 A 2/1988 Rhyner
4,735,320 A 4/1988 Hoss
D297,187 S 8/1988 Kaczmarek
4,762,227 A 8/1988 Patterson
4,817,769 A 4/1989 Saliba
4,828,081 A 5/1989 Nordstrom et al.
4,837,590 A 6/1989 Sprague
7,854,732 B2 8/1989 Italizi
4,874,093 A 10/1989 Pharo
4,901,897 A * 2/1990 Briggs et al. ..... 224/153
4,907,633 A 3/1990 Eckstein
4,919,240 A 4/1990 Tobias
4,946,036 A 8/1990 Kupersmith
5,010,988 A 4/1991 Brown
5,024,328 A 6/1991 Bontrager
5,031,763 A 7/1991 Lynam
5,056,665 A 10/1991 Boeckeret et al.
5,105,338 A 4/1992 Held
5,105,920 A 4/1992 Grebenstein
5,128,829 A 7/1992 Loew
5,129,519 A 7/1992 David et al.
5,150,776 A 9/1992 Rebenack
5,160,001 A 11/1992 Marceau
5,207,327 A 5/1993 Brondos
5,210,904 A 5/1993 Pratt
5,211,290 A 5/1993 Janus et al.
5,217,119 A 6/1993 Hollingsworth
5,221,005 A 6/1993 Hayward
5,226,542 A 7/1993 Boecker et al.
5,249,653 A 10/1993 King
5,251,102 A 10/1993 Kimble
5,330,049 A * 7/1994 Bertelsen et al. ..... 206/279
5,341,929 A 8/1994 Stefancin, Jr.
5,348,347 A 9/1994 Shink
5,402,892 A 4/1995 Jaszai
2,708,989 A 5/1995 Bogdanski
5,445,266 A 8/1995 Prete et al.
5,469,945 A 11/1995 Jserng
5,494,157 A 2/1996 Golenz et al.
5,524,754 A 6/1996 Hollingsworth
5,544,792 A * 8/1996 Arnwine ..... 224/153
5,555,157 A 9/1996 Moller et al.
5,555,960 A 9/1996 Bartsch
5,607,054 A 3/1997 Hollingsworth
5,622,262 A 4/1997 Sadow
5,624,035 A 4/1997 Kim
5,676,223 A 10/1997 Cunningham
5,676,509 A 10/1997 Enzu
5,678,666 A 10/1997 Shyr et al.
5,706,935 A 1/1998 Lorton
5,725,090 A 3/1998 Vermillion et al.
5,755,329 A 5/1998 Sadow
5,762,170 A 6/1998 Shyr et al.
5,765,688 A 6/1998 Bertram et al.
5,769,231 A 6/1998 Batsford
5,769,232 A 6/1998 Cash et al.
5,775,497 A 7/1998 Krulik
5,788,032 A 8/1998 Krulik
5,797,044 A 8/1998 Lawther et al.
5,808,865 A 9/1998 Alves
5,819,942 A 10/1998 Sadow
5,826,770 A 10/1998 Chuang
5,829,099 A 11/1998 Kopelman et al.

(56) References Cited

U.S. PATENT DOCUMENTS

| | | | | |
|---|---|---|---|---|
| 5,833,352 | A | 11/1998 | Goodwin | |
| D403,151 | S | 12/1998 | Heredos-Formby | |
| 5,857,568 | A | 1/1999 | Speirs | |
| 5,881,850 | A | 3/1999 | Murdoch | |
| 5,884,768 | A | 3/1999 | Fox | |
| 5,887,723 | A | 3/1999 | Myles et al. | |
| 5,887,777 | A | 3/1999 | Myles et al. | |
| 5,908,147 | A | 6/1999 | Chuang | |
| 5,909,759 | A | 6/1999 | Tanaka et al. | |
| 5,909,806 | A | 6/1999 | Fischel et al. | |
| 5,954,170 | A | 9/1999 | Chisholm | |
| 5,960,952 | A | 10/1999 | Chen | |
| 5,967,270 | A | 10/1999 | Shyr | |
| 5,971,148 | A * | 10/1999 | Jackson | 206/320 |
| 5,996,180 | A | 12/1999 | Eisenzopf | |
| 6,024,054 | A | 2/2000 | Matt et al. | |
| 6,059,079 | A | 5/2000 | Krulik | |
| 6,062,356 | A | 5/2000 | Nykoluk | |
| 6,062,357 | A | 5/2000 | Bogert | |
| 6,073,770 | A | 6/2000 | Park | |
| 6,082,543 | A | 7/2000 | Béliveau | |
| 6,098,768 | A | 8/2000 | Tsai | |
| 6,105,763 | A | 8/2000 | Saetia | |
| 6,105,764 | A | 8/2000 | Scicluna et al. | |
| 6,105,766 | A | 8/2000 | Chuang | |
| 6,109,434 | A | 8/2000 | Howard, Jr. | |
| 6,131,734 | A | 10/2000 | Hollingsworth et al. | |
| 6,145,337 | A | 11/2000 | Wilson | |
| 6,145,661 | A | 11/2000 | Jung | |
| 6,173,933 | B1 | 1/2001 | Whiteside et al. | |
| 6,179,431 | B1 | 1/2001 | Chien | |
| 6,193,118 | B1 | 2/2001 | Kearl | |
| 6,213,266 | B1 | 4/2001 | Hollingsworth | |
| 6,213,267 | B1 | 4/2001 | Miller | |
| 6,227,339 | B1 | 5/2001 | Bogert | |
| 6,237,766 | B1 | 5/2001 | Hollingsworth | |
| 6,257,407 | B1 | 7/2001 | Truwit et al. | |
| 6,286,645 | B1 | 9/2001 | Chen | |
| 6,295,650 | B1 | 10/2001 | Baacke | |
| 6,318,552 | B1 | 11/2001 | Godshaw | |
| 6,334,533 | B1 | 1/2002 | Hollingsworth et al. | |
| 6,334,534 | B1 | 1/2002 | Hollingsworth et al. | |
| 6,338,180 | B1 | 1/2002 | Massard | |
| 6,354,477 | B1 | 3/2002 | Trummer | |
| 6,360,402 | B1 | 3/2002 | Crabtree | |
| 6,390,297 | B1 | 5/2002 | Hollingsworth | |
| 6,439,389 | B1 | 8/2002 | Mogil | |
| 6,499,187 | B2 | 12/2002 | Hollingsworth et al. | |
| 6,535,199 | B1 | 3/2003 | Canova, Jr. et al. | |
| D476,149 | S | 6/2003 | Andre et al. | |
| 6,629,588 | B2 | 10/2003 | Nykoluk et al. | |
| 6,687,955 | B2 | 2/2004 | Hollingsworth | |
| 6,746,638 | B1 | 6/2004 | Zadesky et al. | |
| 6,772,879 | B1 | 8/2004 | Domotor | |
| 6,785,566 | B1 | 8/2004 | Irizarry | |
| D500,923 | S | 1/2005 | Gonzalez | |
| 6,925,739 | B1 | 8/2005 | Cole et al. | |
| 7,048,103 | B2 | 5/2006 | Hollingsworth | |
| D527,176 | S | 8/2006 | Andre et al. | |
| D529,717 | S * | 10/2006 | Brancky | D3/285 |
| D533,348 | S | 12/2006 | Andre et al. | |
| 7,207,154 | B2 * | 4/2007 | Araujo | 53/410 |
| D541,646 | S | 5/2007 | Hayes et al. | |
| 7,216,763 | B2 | 5/2007 | Gormick et al. | |
| 7,281,698 | B2 | 10/2007 | Patterson, Jr. | |
| D574,375 | S | 8/2008 | Prest et al. | |
| D574,819 | S | 8/2008 | Andre et al. | |
| 7,414,833 | B2 | 8/2008 | Kittayapong | |
| 7,451,872 | B1 * | 11/2008 | Allen | 206/315.11 |
| D582,405 | S | 12/2008 | Andre et al. | |
| 7,467,695 | B2 | 12/2008 | Gormick et al. | |
| 7,495,895 | B2 | 2/2009 | Carnevali | |
| 7,503,440 | B2 | 3/2009 | Gormick et al. | |
| 7,735,644 | B2 | 6/2010 | Sirichae et al. | |
| D623,404 | S | 9/2010 | Andre et al. | |
| D623,638 | S | 9/2010 | Richardson et al. | |
| D623,639 | S | 9/2010 | Richardson et al. | |
| 7,876,550 | B1 | 1/2011 | Albertini et al. | |
| 8,051,980 | B2 | 11/2011 | Tai et al. | |
| D658,363 | S * | 5/2012 | Biddle | D3/217 |
| 8,235,208 | B2 | 8/2012 | Sirichai et al. | |
| 8,312,991 | B2 | 11/2012 | Diebel et al. | |
| 8,328,008 | B2 | 12/2012 | Diebel et al. | |
| 2001/0014010 | A1 | 8/2001 | Jenks et al. | |
| 2001/0042665 | A1 | 11/2001 | Siwak | |
| 2001/0052710 | A1 | 12/2001 | Witherell | |
| 2002/0000390 | A1 | 1/2002 | Hollingsworth | |
| 2003/0042091 | A1 | 3/2003 | Oh | |
| 2003/0132132 | A1 | 7/2003 | Small | |
| 2003/0186729 | A1 | 10/2003 | Engstrom et al. | |
| 2004/0018863 | A1 | 1/2004 | Engstrom et al. | |
| 2007/0051645 | A1 | 3/2007 | Hassett | |
| 2007/0056865 | A1 | 3/2007 | Pelo | |
| 2007/0057140 | A1 | 3/2007 | Liou et al. | |
| 2007/0119734 | A1 | 5/2007 | Pichahchi | |
| 2007/0205122 | A1 | 9/2007 | Oda et al. | |
| 2007/0279855 | A1 | 12/2007 | Linsmeier et al. | |
| 2008/0055835 | A1 | 3/2008 | Kumano et al. | |
| 2008/0237432 | A1 | 10/2008 | Patterson | |
| 2008/0251339 | A1 | 10/2008 | Williams | |
| 2009/0139814 | A1 | 6/2009 | Grossman et al. | |
| 2009/0205985 | A1 | 8/2009 | Freeman et al. | |
| 2009/0223765 | A1 * | 9/2009 | Bosma | 190/108 |
| 2009/0223845 | A1 * | 9/2009 | Bosma et al. | 206/320 |
| 2009/0238335 | A1 | 9/2009 | Ripp et al. | |
| 2009/0294235 | A1 | 12/2009 | Santy et al. | |
| 2010/0072334 | A1 | 3/2010 | Le Gette et al. | |
| 2011/0315579 | A1 | 12/2011 | Mase | |

FOREIGN PATENT DOCUMENTS

| | | | |
|---|---|---|---|
| EP | 797939 | A3 | 7/1998 |
| FR | 2391668 | A | 12/1978 |
| GB | 146601 | | 7/1920 |
| GB | 161117 | | 4/1921 |
| JP | 135796 | | 11/1978 |
| JP | 3222728 | | 10/1991 |
| JP | H073344 | U | 1/1995 |
| JP | 09135722 | A | 5/1997 |
| JP | 11299521 | A | 11/1999 |
| JP | 2000014426 | A | 1/2000 |
| JP | 2000217622 | A | 8/2000 |
| JP | 2004509680 | A | 4/2004 |
| JP | 2004231158 | A | 8/2004 |
| KR | 100362369 | B1 | 11/2002 |
| RU | 1638073 | | 3/1991 |
| WO | WO 2010/036090 | A2 | 4/2010 |
| WO | WO 2011/115918 | A1 | 9/2011 |

OTHER PUBLICATIONS

Office Action for U.S. Appl. No. 10/939,346, filed Sep. 14, 2004, mailed Apr. 8, 2008 14 pgs.

Office Action for U.S. Appl. No. 13/308,192, filed Nov. 30, 2011, and mailed Mar. 23, 2012 (14 pgs.).

Office Action for U.S. Appl. No.13/308,192, filed Nov. 30, 2011, and mailed Aug. 27, 2012 (14 pgs.).

Office Action for U.S. Appl. No. 13/171,225, filed Jun. 28, 2011, and mailed from the USPTO on Apr. 16, 2013, 24 pgs.

Office Action for U.S. Appl. No. 13/791,445, filed Mar. 8, 2013, and mailed from the USPTO on Jun. 21, 2013, 20 pgs.

Office Action for U.S. Appl. No. 13/285,565, filed Oct. 31, 2011, and mailed from the USPTO on May 9, 2013, 11 pgs.

MacWorld, "PortTM: the best cradle for your powerbook," Apr. 1993.

US 3,694,155, 09/1972, Laurita (withdrawn)

* cited by examiner

PORTABLE COMPUTER CASE

CROSS-REFERENCE TO RELATED APPLICATIONS

This application claims the benefit of U.S. Provisional Application No. 61/036,394 filed Mar. 13, 2008, for "Portable Computer Case," which is incorporated herein by reference in its entirety.

This application claims the benefit of U.S. Provisional Application No. 61/053,468 filed May 15, 2008, for "Portable Computer Case," which is incorporated herein by reference in its entirety.

TECHNICAL FIELD

The disclosure relates generally to all carrying cases. In particular, the disclosure relates to carrying cases that provide convenient security screening of an electronic device, such as a computer disposed within the carrying case.

BRIEF DESCRIPTION OF THE DRAWINGS

A more particular description will be rendered by reference to the appended drawing. Understanding that these drawings only provide information concerning typical embodiments of the cases disclosed herein and, as such, the drawings are not to be considered limiting of the scope of the disclosure, embodiments are described and explained with additional specificity and detail through the use of the accompanying drawings, in which.

DETAILED DESCRIPTION OF PREFERRED EMBODIMENTS

The presently preferred embodiments will be best understood by reference to the drawings, wherein like parts are designated by like numerals throughout. It will be readily understood that the components, as generally described and illustrated in the figures herein, could be arranged and designed in a wide variety of different configurations. Thus, the following more detailed description of the embodiments of the apparatus is not intended to limit the scope as claimed, but is merely representative of presently preferred embodiments. Specific examples are given to illustrate aspects of various embodiments, but those of skill in the relevant art(s) will understand that other examples may also fall within the meaning of the terms used, and hence, within the scope of one or more claims.

Portable computers, such as laptop or notebook computers are very popular due to their transportability, allowing such computers to be used in various places during and/or following transport. To enhance transportability, portable computers are typically designed to minimize size and weight. Computer cases are designed to transport portable computers and provide some degree of protection against impact.

When traveling through airport security, it is the policy under the Transportation Security Administration (TSA) to remove portable computers from luggage, cases, and the like. Other scanning authorities may have similar requirements. Removal of the computers from the case removes obstructions and/or interference when screening the computer. As used herein, screening and/or scanning refers to techniques of electromagnetic transmission to view the internal components of a portable computer using, for example, an X-ray scanner or the like. The removal of a computer from the case is often inconvenient and subjects the portable computer to increased risk of damage or loss. As airport screening often takes place in a crowded and busy environment, it would be advantageous to facilitate screening for the portable computer user. A carrying case may position the portable computer within the case or partially within the case while still enabling effective screening of the portable computer.

Figure 1A:
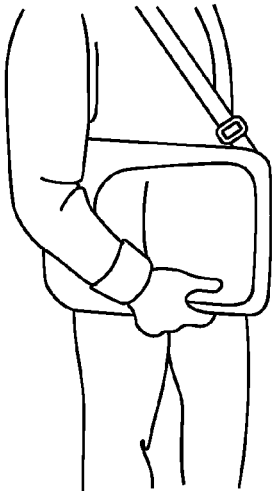
FIGS. 1A-C are perspective views of one embodiment of a computer case.
Figure 1B:
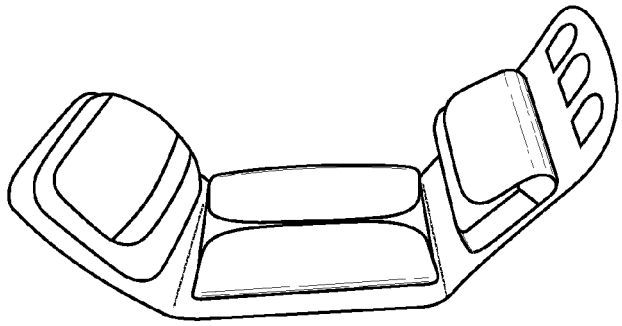
Figure 1C:
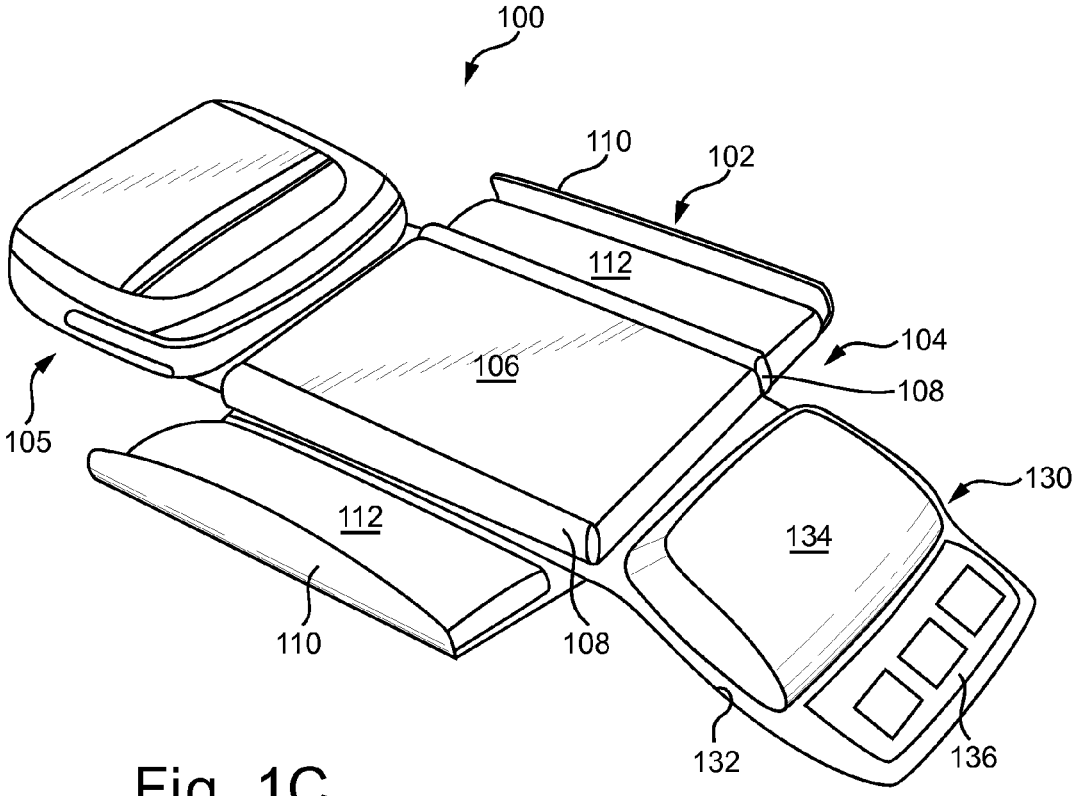

Referring to FIGS. 1A-C, views are shown of one embodiment of a carrying case 100. The carrying case 100 is configured to fold together in a "wallet" fashion to enable quick access and screening of contents. The carrying case 100 comprises a computer section 102 that includes a computer receiving area 104, into which a portable computer 106 is disposed. The computer receiving area includes a back panel (not shown), which may comprise any number of acceptable materials. The computer receiving area 104 may be defined by opposing edge cushions 108 that may contact and support the computer 106. The opposing edge cushions 108 provide a buffer against impact and may be arranged in a variety of configurations. In one embodiment, the edge cushions 108 may extend partially or entirely around a computer perimeter.

The computer section 102 may further include first and second flap panels 110 that extend over the computer receiving area 104 and substantially cover a computer 106. The flap panels 110 may each include flap cushions 112 to rest against a computer 106 and protect against impact.

The case 100 may further include a liquids section 130 that is coupled to and folds across the computer section 102. The liquids section 130 includes a back panel 132 that supports a clear case 134. The clear case 134 provides a container for appropriate sizes of liquids, gels, and the like. The clear case 134 may be of an acceptable size for the TSA, such as one quart, and allows for quick and convenient visual inspection of the contents. The clear case 134 may comprise a material that accommodates screening and is sufficiently transparent to allow for visual inspection.

The liquids section 130 may further include an information panel 136, which is disposed on the back panel 132. The information panel 136 may list screening information to assist a traveler in complying with the current screening policies of the TSA (or other scanning authority). For example, the information panel 136 may list the individual size limits for liquids and gels and the total limit for all liquids and gels. The information panel 136 may also include additional information of interest to a traveler. When packing, the information panel 136 is unfolded and prominently displayed to a traveler.

The case 100 may further include a storage section 105 that is coupled to and folds across the computer section 102. The storage section 105 may be configured in a variety of shapes and sizes and provide space to accommodate desired objects.

In operation, the computer case 100 may be quickly unfolded to expose the computer 106 and the clear case 134 for visual inspection. After inspection, the computer case 100 may be folded in a relatively simple manner to configure the case 100 for transport. Furthermore, the computer 106 may be screened through conventional techniques without obstruction. The back panel of the computer section 102 comprises a material that would not interfere with the screening process.

Figure 2:
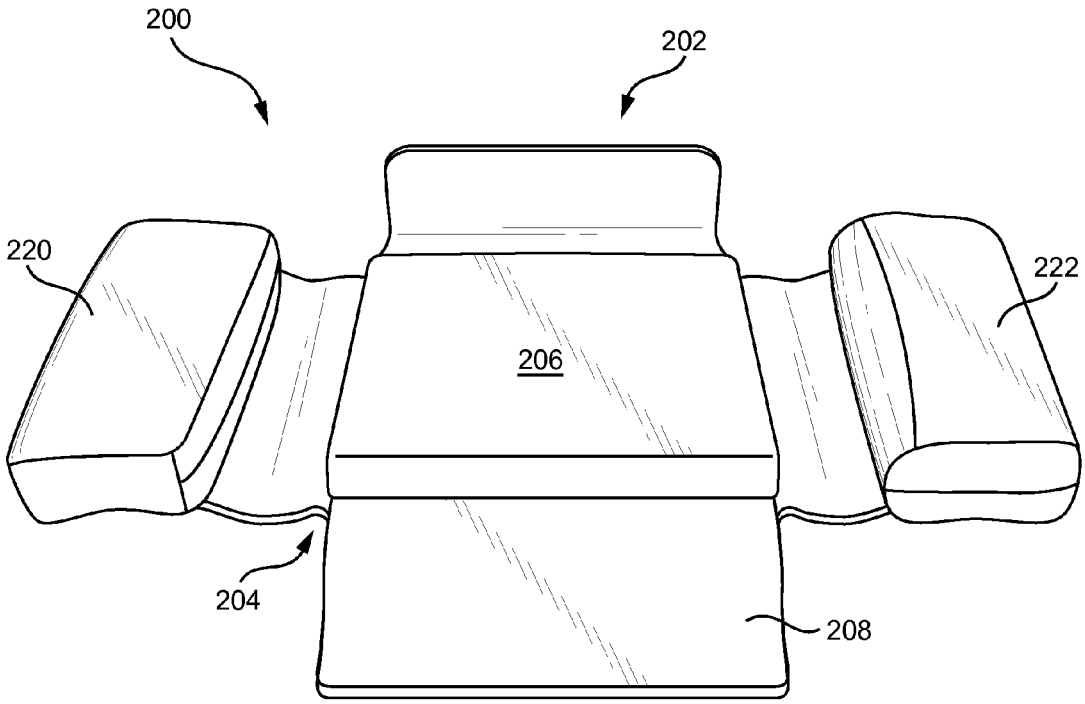
FIG. 2 is a perspective view of one embodiment of a computer case.

Referring to FIG. 2, an alternative embodiment of a computer case 200 is shown. The case 200 includes a computer section 202 with a computer panel 204 that receives a portable computer 206. The computer section 202 includes first and second opposing flap panels 208 that fold over the computer 206. The computer 206 may be secured to the computer section 202 by one or more straps (not shown). The straps and the computer panel 204 comprise a material that does not interfere with the screening of the computer 206.

The computer section 202 is coupled to first and second storage sections 220 and 222, which extend from opposing sides of the computer section 202. The storage sections 220 and 222 provide space to receive desired objects and fold over the computer section 202. When assembled, the computer case 200, similar to the case 100, provides a compact and portable unit. The computer case 200 is easily unfolded to expose the computer 206.

Figure 3A:
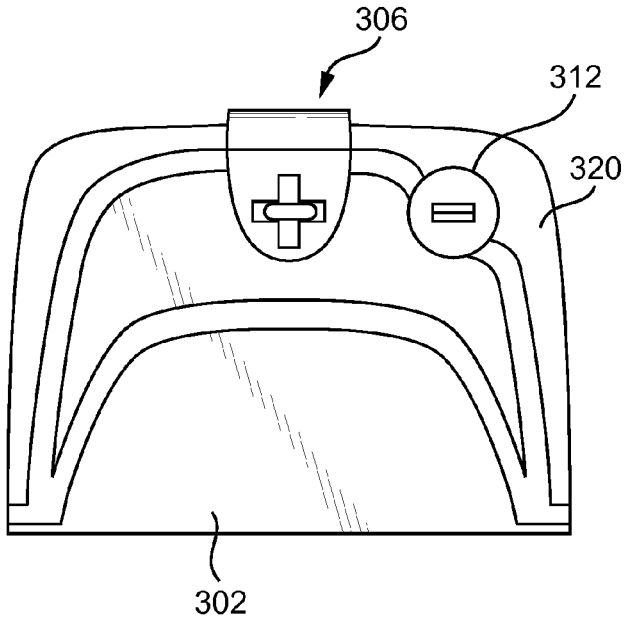
FIGS. 3A-B are views of one embodiment of a computer case.
Figure 3B:
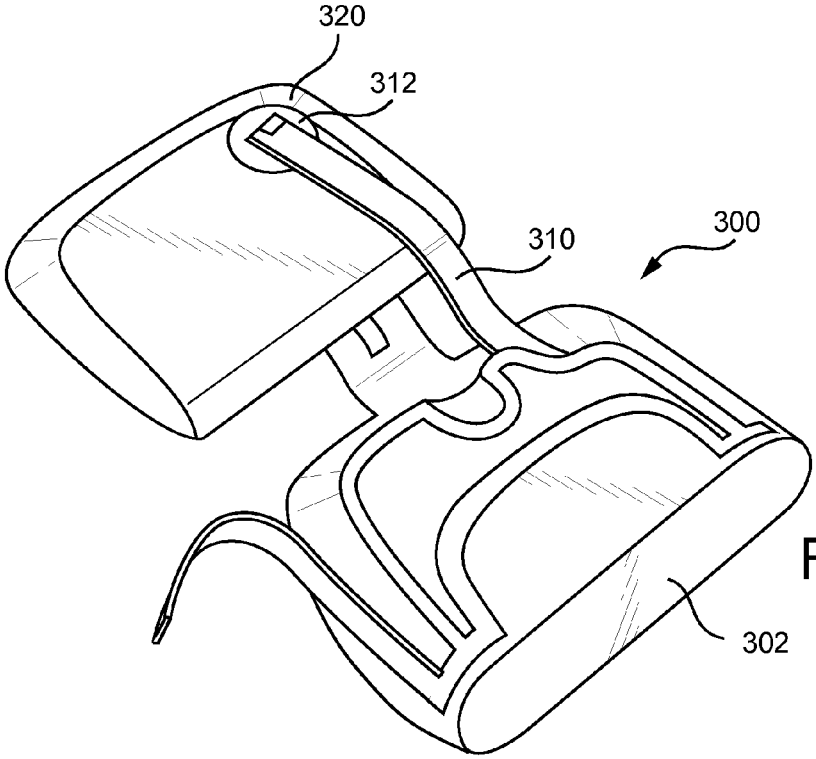

Referring to FIGS. 3A-B, an alternative embodiment of a computer case 300 is shown. The case 300 includes a pouch 302 that receives, supports, protects, and at least partially covers a portable computer 304. The pouch 302 may comprise any one of a number of materials and may include buffers to protect the computer 304. The case 300 may include a fastener 306 coupled to the pouch 302. When the portable computer 304 is disposed within the pouch 302, the fastener 306 may extend over the computer 304 and secure the computer 304 within the pouch.

The case 300 further includes a retractable tether 310 that is coupled to the pouch 302 and to a computer lock 312. The computer lock 312 is secured to the computer 304 to ensure that the computer 304, tether 310, and pouch 302 all remain connected when the computer 304 is removed from the pouch 302. The computer lock 312 may include a conventional lock and key assembly or biometric scanner, such as a fingerprint scanner to unlock the tether 310 from the computer 304. In one embodiment, TSA agents may be provided with a master key to unlock the computer lock 312 and thereby facilitate inspection of the computer 304. The computer lock 312 may further include an alarm, such as a piezo alarm. If the computer lock 312 is broken or forced, the alarm generates an audio or visual warning.

The case 300 may further include a protective covering 320 that partially covers the computer 304. In particular, the protective covering 320 covers the portion of the computer 304 that remains exposed when the computer is nested within the pouch 302. The case 300 may further include additional pouches to store objects.

In operation, the computer 304 may be quickly removed from the pouch 302 for scanning. When disengaged from the pouch 302, the computer 304 remains secured to the pouch 302 for convenience and security.

Figure 4:
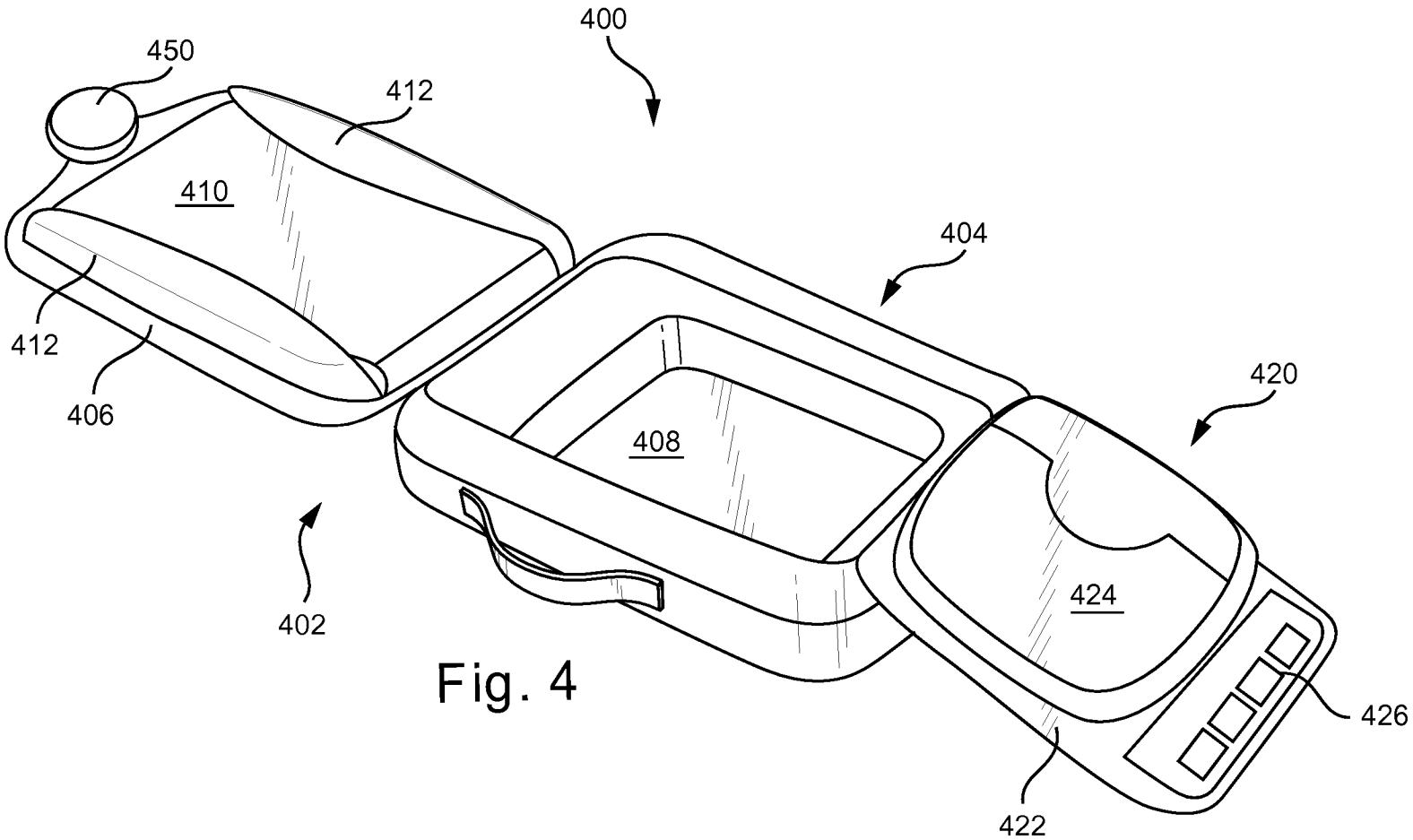
FIG. 4 is a perspective view of one embodiment of a computer case.

Referring to FIG. 4, an alternative embodiment of a computer case 400 is shown. The computer case 400 comprises a computer section 402, which includes a base section 404 and a front panel 406. The base section 404 defines a recess 408 to receive the portable computer 410. The portable computer 410 rests on the front panel 406 and may be secured to the front panel through one or more straps (not shown). Alternatively, the portable computer 410 may be secured by friction to one or more cushions 412.

The front panel 406 is coupled to the base section 404 and folds across the base section. Accordingly, closing the front panel 406 secures the computer 410 within the base section 404, and opening the front panel 406 removes the portable computer 410 from the base section 404 and exposes the portable computer 410 for screening. The front panel 406 comprises a material that does not interfere with the screening process.

The case 400 may further include a liquids section 420 that is coupled to and folds across the computer section 402. The liquids section 420 includes a back panel 422 that supports a clear case 424 similar to the clear case 134 described above. The liquids section 420 may further include an information panel 426, which is disposed on the back panel 422 and is similar to the information panel 136 described above. In the embodiments of FIGS. 1A-C and 4, a liquids section is disclosed, although the liquids section is optional.

In one embodiment, the case 400 may include a transmitter 450 to wirelessly transmit information relating to the computer 410. The transmitter 450 would be approved for use by the TSA and would be compatible for interfacing with TSA equipment. The transmitter 450 may comprise a memory with an image of the scanned computer 410. Thus, the image is specific to the computer 410 model. If the computer is altered or customized, the image is then updated. The image is transmitted from the case 400 to a TSA device with a suitable display. The transmitted image is compared to the present scan of the computer 410, as the computer is screened. The comparison of the transmitted image with the presently scanned image allows a TSA agent to confirm whether the computer 410 has been altered. The transmitter 450 may be configured using conventional techniques to transmit the desired image when needed.

As can be appreciated, the transmitter 450 could be included in any of the cases 100-1300 disclosed herein and is not limited to only the embodiment of FIG. 4.

Figure 5A:
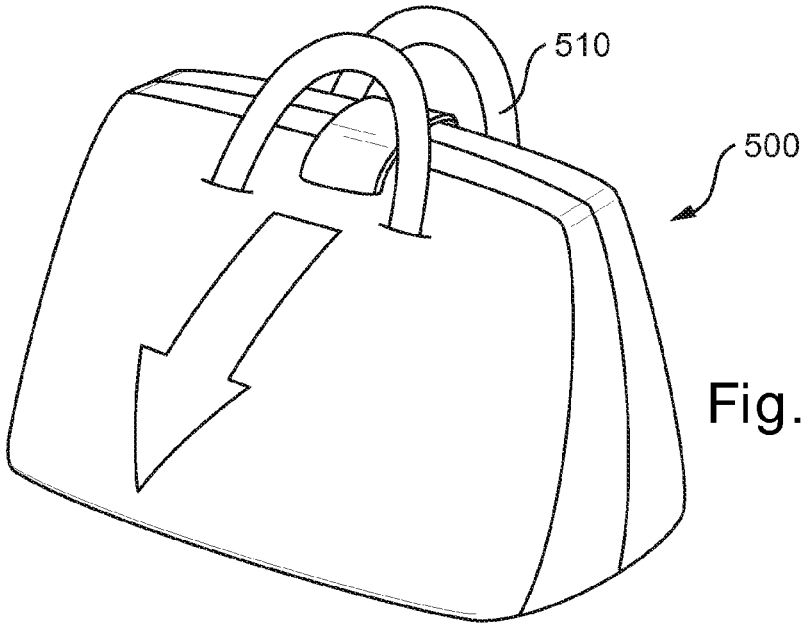
FIGS. 5A-B are perspective views of one embodiment of a computer case.
Figure 5B:
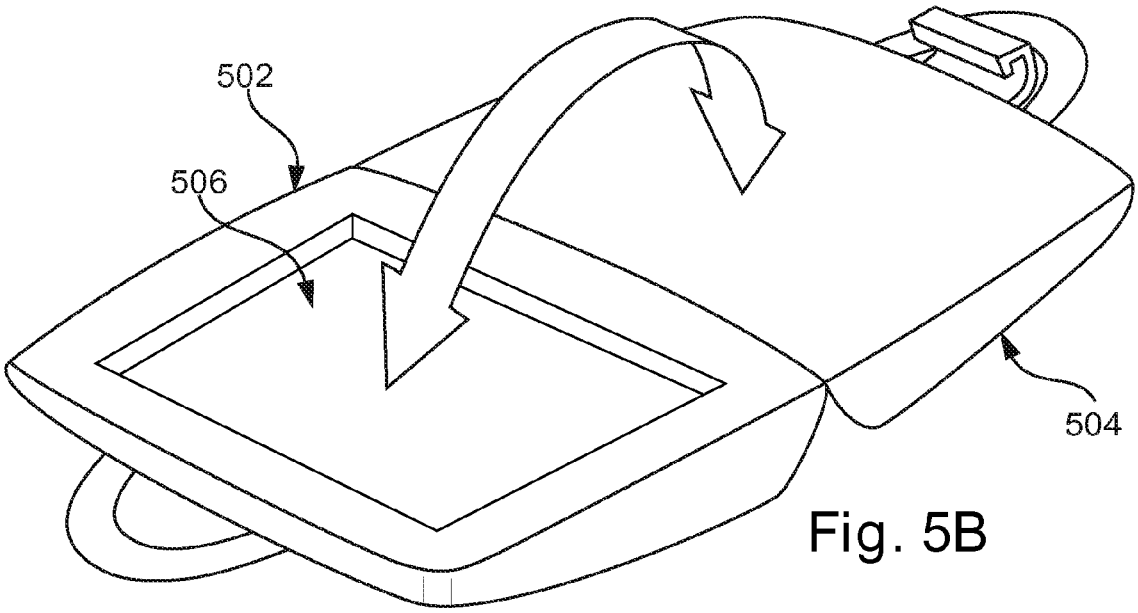

Referring to FIGS. 5A-B, an alternative embodiment of a computer case 500 is shown. The computer case 500 comprises a computer section 502 that is coupled to a storage section 504. When the case 500 is in the closed configuration (shown in FIG. 5A), the computer storage section 502 and the storage section 504 may be approximated to form a "clamshell" type of configuration. As seen in FIG. 5B, the computer section 502 includes a recess 506 that is configured to receive a portable computer. The computer section 502 and storage section 504 may be pivotably connected to one another through use of a material, hinge, straps, or the like. When the case 500 is closed, the sections 502, 504 abut one another. A closed case 500 may be secured through use of a conventional locking device 510 (e.g., latch). When the case 500 is opened, the section interiors are exposed and a computer disposed within the computer section 502 may be available for screening. The computer section 502 may comprise a material that does not interfere with screening. In this manner, a computer (not shown) may be screened by quickly removing the computer from proximity to objects in a storage section.

Although not shown in FIG. 5, in some embodiments, an inner side of the computer section 502 may comprise a cover (not shown). The cover may be configured to cover a computer (not shown) disposed within the recess 506. The cover may protect the computer from loss or damage during a screening process. The cover may be comprised of materials configured to allow a computer disposed within the case 500 to be scanned without removing the cover and/or removing the computer from the case 500. In some embodiments, the cover may be substantially transparent to allow visual inspection of the contents of the recess 506.

Figure 6:
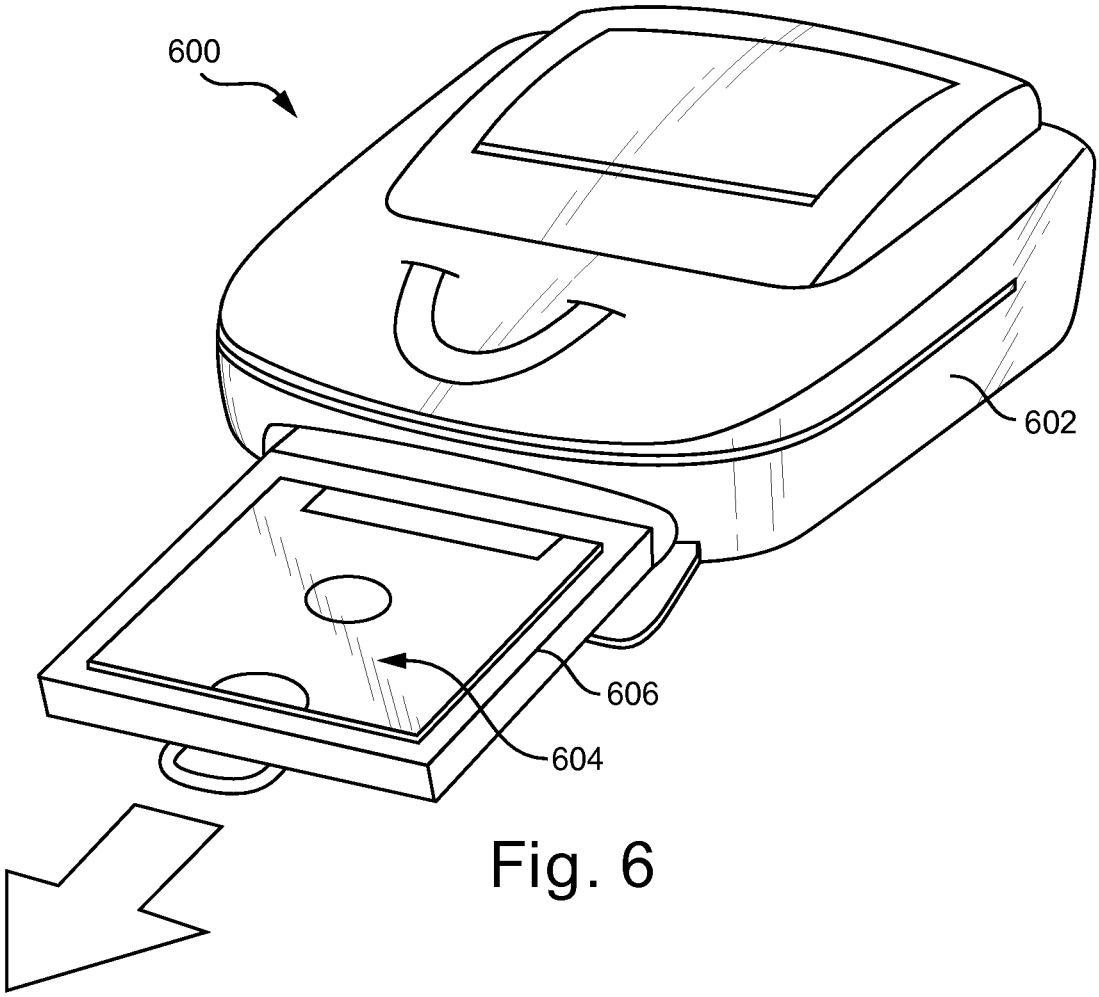
FIG. 6 is a perspective view of one embodiment of a computer case.

Referring to FIG. 6, an alternative embodiment of a computer case 600 is shown, which comprises a base section 602 and an extendable tray 604. The extendable tray 604 comprises a recess to receive, support, and protect a portable computer 606. In a closed position, at least the majority of the extendable tray 604 rests within the base section 602. In an open position, the extendable tray 604 extends sufficiently from the base section 602 to expose the computer 606 for screening. The tray 604 may be configured to extend from a top, side, or bottom of the computer case 600.

The tray 604 may comprise cushions to support and protect the computer 606. The tray 604 may comprise a support panel upon which the computer 606 rests. The tray may also comprise first and second support members that are connected to and disposed on opposing sides of the support panel. The support panel may comprise a material that does not interfere with the computer screening process. Accordingly, during screening, a computer may be quickly and conveniently removed from proximity to other objects in the base section 602 and from the base section 602 itself.

In the embodiment of FIG. 6, the extendable tray supporting a portable computer may be defined as a computer section. The tray extends or slides from the remainder of the computer case to remove the portable computer from the main body of the computer case.

Figure 7A:
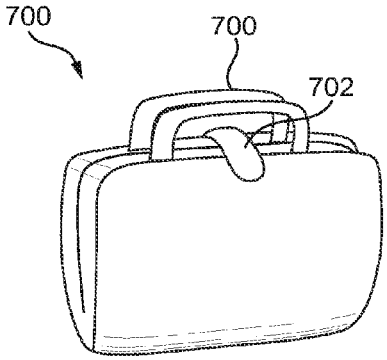
FIGS. 7A-E are views of one embodiment of a computer case.
Figure 7B:
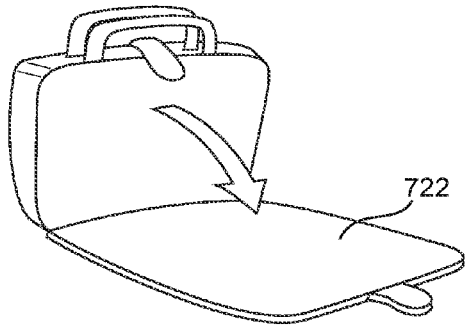
Figure 7C:
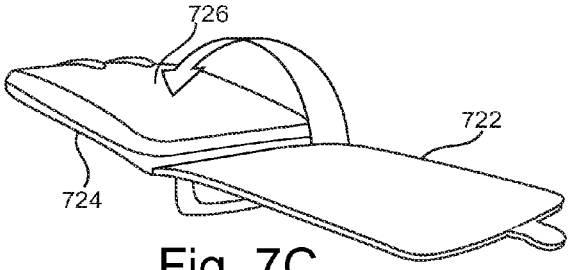
Figure 7D:
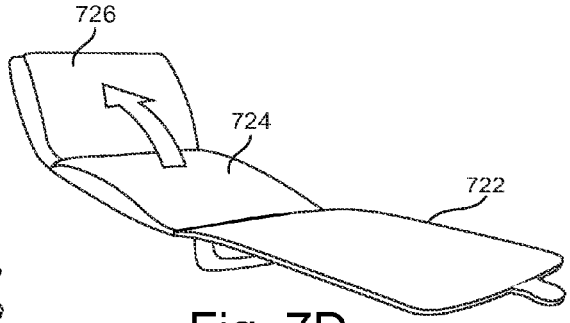

FIGS. 7A-E depict another embodiment of a computer case 700 having a tri-fold configuration, which may comprise a first storage section 722, a second storage section 724, and a third storage section 726. The storage sections 722, 724, and 726 may be foldably connected using foldable material, a hinge, straps, or the like and held in place by a fastener 702 (e.g., the fastener 702 may maintain the case 700 in the folded configuration as depicted in FIG. 7A). The fastener 702 may comprise any fastening means known in the art including, but not limited to: a buckle, a button, a pin, a strap, Velcro®, a zipper, or the like. The fastener 702 may further comprise locking means, such as a lock, a piezo alarm, a TSA approved luggage lock, or the like. The case 700 may be laid flat (e.g., unfolded) by releasing the fastener 702 and unfolding the first storage section 722 (as shown in FIG. 7C) and the third storage section 726 (as shown in FIG. 7D).

A computer (not shown) may be disposed in one or more of the storage sections 722, 724, and/or 726. In the embodiment depicted in FIGS. 7A-E, the third storage section 726 may be adapted to hold a computer. The third storage section 726 may comprise padding 704 to protect the computer stored therein from damage. A cover 727 of the third storage section 726 may be adapted to allow the computer stored therein to be scanned by a scanning device, such as an X-ray scanner or the like. In some embodiments, the cover 727 may be substantially transparent or semi-transparent to allow a screener, such as a TSA screener or other security personnel, to visually inspect the computer within the third storage section 726.

The materials of the case 700, the third storage section 726, and/or the cover 727 may be adapted to allow for screening of a computer without removal of the computer from the third storage section 726. As such, the third section 726 and the covering 727 (and the rest of the case 700) may be comprised of materials that do not interfere with TSA screening procedures and techniques (e.g., X-ray scanners or the like).

The case 700 may comprise a foldable container 730, which may be disposed between one or more of the storage sections 722, 724, and/or 726. The foldable container 730 (e.g., pocket container) may comprise a pouch, foldout tray, or other foldable container type. The foldable container 730 may comprise a plurality of panels connected by one or more deformable edges. The deformable edges may allow the foldable container 730 to transition from a folded configuration to an open, unfolded configuration as the case 700 is folded and unfolded, respectively.

The foldable container 730 may be configured to fold between one or more of the storage sections 722, 724, and/or 726 when the case is in the folded configuration (e.g., as shown in FIG. 7A) and/or when the storage sections proximate to the foldable container 730 (e.g., storage sections 724 and 726) are in a folded configuration.

When the case 700 is in the open, unfolded configuration and/or when the storage sections proximate to the foldable container 730 are open and unfolded (e.g., the storage sections 724 and 726), the foldable container 730 may be configured to open (e.g., unfold) to form a container. When in the open, unfolded configuration, the container 730 may be configured to receive one or more personal items 740, such as wallet, keys, change, a watch, or the like. The personal items 740 may be items that the TSA (or other scanning authority) requires pass through a scanning device 750 during a security screening process. Alternatively, or in addition, the personal items 740 may comprise items that must be removed before a passenger may pass through a human scanning device, such as a metal detector or the like.

Figure 7E:
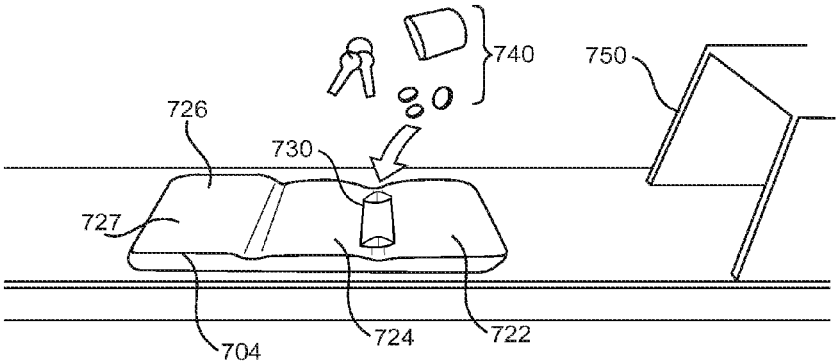

As shown in FIG. 7E, the personal items 740 may be placed in the foldable container 730 to pass through a scanning device 750, such as an X-ray scanner or the like. As such, the foldable container 730 may be comprised of materials configured to allow the personal items 740 disposed therein to be scanned by the scanning device 750 (e.g., the materials comprising the foldable container 730 may not interfere with the scanning device 750).

In addition, the foldable container 730 may be comprised of materials that are configured to allow for scanning of the contents of the storage sections 722 and 724 proximate to the foldable container 730 by the scanner 750 (e.g., the materials comprising the foldable container 730 may not interfere with the scanning of the storage sections 722 and/or 724).

The foldable container 730 may be configured to allow for visual inspection of the personal items 740 disposed therein. As such, the container 730 may be open-ended, may be comprised of substantially transparent materials, may be comprised of a mesh material (e.g., nylon mesh), may be comprised of sheer materials, or the like. In these embodiments, a TSA screener (not shown) may be able to view and/or screen the items 740 placed therein without removing the items 740 from the foldable container 730. In addition, the materials comprising the foldable container 730 may be configured to allow for visual screening of the contents of the storage sections 724 and 722 (e.g., the foldable container 730 may be substantially transparent).

In some embodiments, the foldable container 730 may be configured to secure the items 740 disposed to prevent loss and/or theft of the items 740 during a screening process (e.g., as the case 700 passes through the scanner 750). As such, the foldable container 730 may comprise a cover (not shown) and/or means for securing the items 740 (not shown), such as a fastener, locking device, drawstring, alarm, or the like. The cover and/or means for securing the cover may be configured to allow for screening of the items 740 and/or the rest of the contents of the case 700 using the scanning device 750 (e.g., the cover and means for securing the cover may be comprised of materials that do not interfere with the operation of the scanning device 750). In addition, the cover and/or means for securing the cover may be configured to allow the contents 740 thereof to be visually inspected (e.g., may be comprised of substantially transparent materials, a mesh material, a sheer material, or the like).

Although FIGS. 7D and 7E show the foldable container 730 disposed in a center portion of the case 700, in other embodiments, the foldable container 730 may be disposed proximally to one of the sides of the case 700. When so disposed, the contents 740 of the foldable container 730 may be removed by tilting the case 700 to the side. When tilted, the foldable container 730 may be configured to allow the items 740 to slide out of the foldable container 730 for easy removal.

Although FIGS. 7D and 7E show a case 700 comprising a foldable container 730, the teaching of this disclosure may be applied to other container types. For example, a pocket container (not shown) may be used to hold the personal items 740. The pocket container may be disposed on an inner side of the case 700. For example, one of the storage sections 722 or 724 may comprise a recessed pocket area (pocket container), into which the personal items 740 may be placed. The pocket container may be comprised of materials configured to allow the items 740 to be scanned by the scanning device 750 without removing the items 740 form the pocket container. Alternatively, or in addition, the pocket container may be comprised of materials that are substantially transparent to allow for visual inspection of the items 740. The pocket container may comprise means for securing the items 740 therein (e.g., Velcro®, a zipper, or the like).

The case 700 may allow a user to quickly move through a screening process, such as TSA security screening. A user may unfold the case 700 (e.g., as shown in FIGS. 7C and 7D). The unfolding may expose a computer (not shown) disposed within the case. In addition, the unfolding may cause the foldable pocket 730 to unfold into its open, unfolded configuration. The user may place personal items 740 within the foldable container 730 and pass the case 700 through a screening device 750 (e.g., an X-ray scanner) for screening without removing the computer (not shown) from the case 700.

As discussed above, the case 700 may comprise indicia (not shown) indicating that the case 700 complies with TSA scanning regulations (e.g., is configured to allow for scanning of the contents of the case 700). Examples of various indicia are provided and described in additional detail below. Screening personnel (e.g., TSA screeners) and/or a scanning device may detect the indicia and allow the case 700 to be screened using expedited procedures (e.g. allow screening of the case 700 using the scanning device 750 without requiring the user to unpack the case 700). In this manner, a computer (not shown) and items 740 disposed within the case 700 may be quickly screened.

Figure 8A:
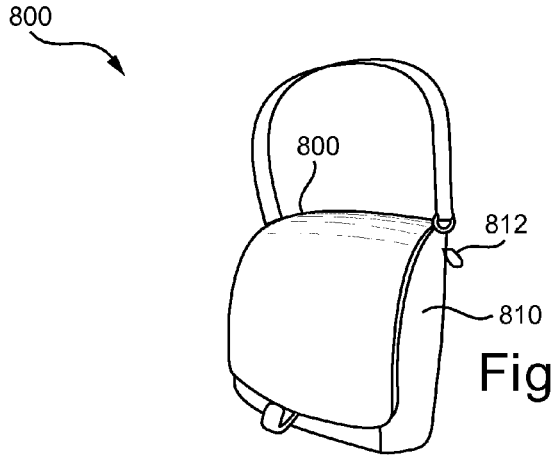
FIGS. 8A-D are views of one embodiment of a computer case.
Figure 8B:
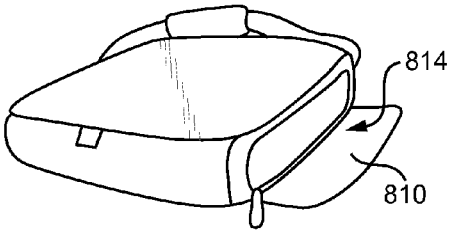

FIGS. 8A-D depict another embodiment of a computer case 800. The computer case 800 may comprise a flap 810 closable by a fastener 812 (e.g., a zipper, Velcro®, or the like). As shown in FIG. 8B, the fastener 812 may be released to open the flap 810 thereby exposing an interior portion 814 of the case 800.

A computer sleeve 804 may be slidably disposed in the interior portion 814 of the case 800. The computer sleeve 804 may be adapted to receive a computer (not shown). The computer sleeve 804 may be padded to prevent damage to the computer. In some embodiments, the computer sleeve 804 may comprise a cover 807 to protect the computer from scratching or other damage. The cover 807 may be comprised of materials configured to allow the computer to be scanned by a scanning device 850 without removing the computer from the cover 807 and/or sleeve 804. Accordingly, the cover 807 and/or sleeve 804 may be comprised of materials adapted to avoid interference with the scanning device 850.

Alternatively, or in addition, the cover 807 may be substantially transparent and/or see-through to allow a screener or other security personnel to visually inspect and/or screen the computer without removing it from the cover 807 and/or computer sleeve 804.

Figure 8C:
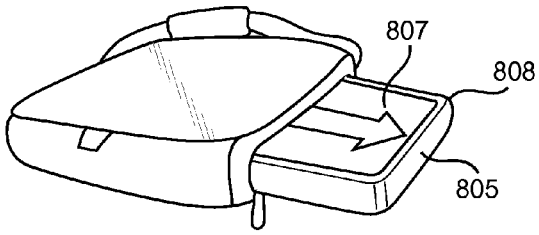

Although not shown in FIG. 8C, the computer sleeve 804 may comprise a handle (not shown) disposed on an end 805 of the computer sleeve 804 to assist in the extraction of the computer sleeve 804 from the interior 814 of the case 800.

Figure 8D:
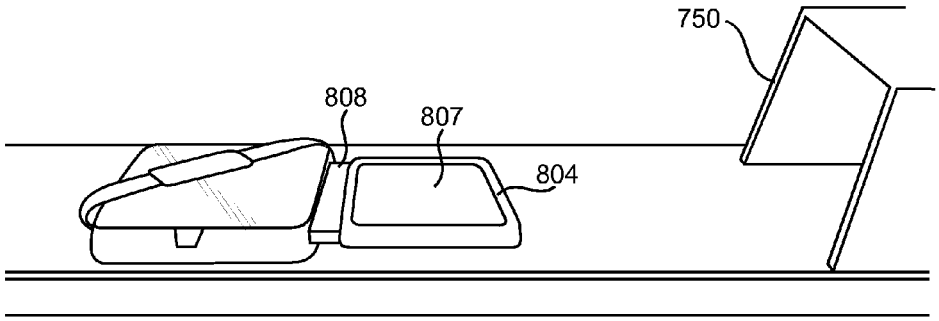

As shown in FIG. 8D, the computer sleeve 804 may be attached to the case 800 by one or more straps 808. The straps 808 may prevent the computer sleeve 804 from being separated from the case 800. In some embodiments, the one or more straps 808 may be formed from an elastic material to assist in retracting the computer sleeve 804 back into the interior portion 814 of the case 800.

When the computer sleeve 804 is extracted, the computer (not shown) disposed therein may be available for scanning by a scanning device 850, such as an X-ray scanner. In addition, as discussed above, the cover 807 may be comprised of a substantially transparent material and/or comprised of materials designed to allow for visual inspection and/or scanning of the computer without removing the computer from the cover 807 and/or sleeve 804.

Figure 9A:
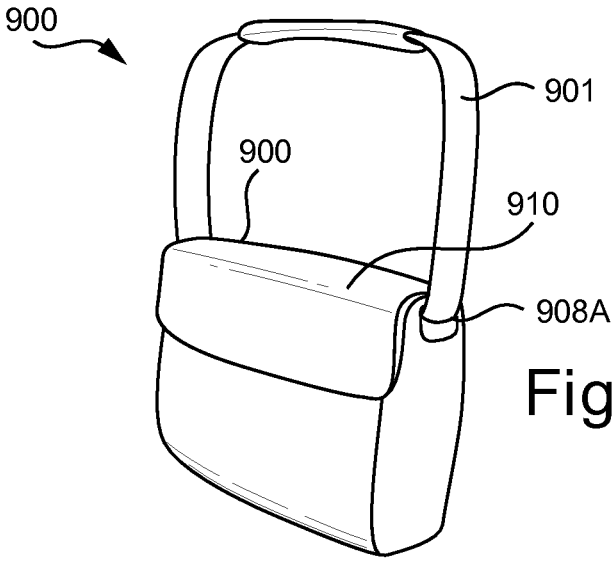
FIGS. 9A-C are views of one embodiment of a computer case.
Figure 9B:
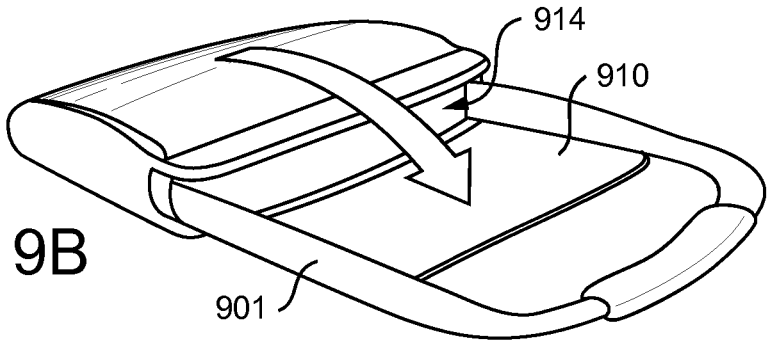
Figure 9C:
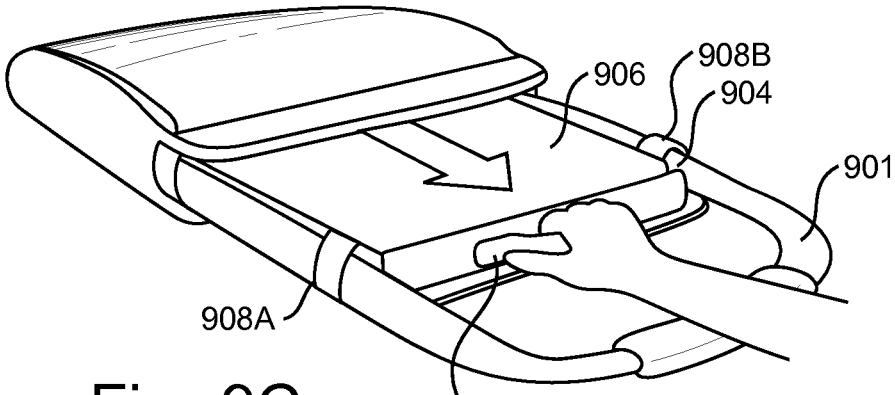

FIGS. 9A-C show another embodiment of a computer case 900. The case 900 comprises a strap 901, which may be used to carry the case 900 (e.g., over a carrier's shoulder). The case 900 comprises a flap 910, which may be used to provide access to an interior portion of 914 of the case 900. Although not shown in FIGS. 9A-C, the flap 910 may be secured in a closed configuration (e.g., in the configuration shown in FIG. 9A) using fastening means (e.g., a latch, magnet, button, Velcro®, or the like).

As shown in FIG. 9C, a computer tray 904 may be slidably disposed within the interior portion 914 of the case 900. The computer tray 904 may be configured to securely receive a computer 906 and may comprise padding and/or a protective covering (not shown) to protect the computer 906 from scratching or other damage.

The computer tray 904 may comprise a handle 905 to assist in the extraction of the computer tray 904 from the interior portion 914 of the case 900. The computer tray 904 may be secured to the case strap 901 via sliders 908A and 908B. The sliders 908A and 908B may be comprised of any material capable of sliding along the strap 901 (e.g., fabric, plastic, rubber, or the like). The sliders 908A and 908B may prevent the tray 904 from being separated from the case 900. Accordingly, as the tray 904 is extracted from the interior 914 of the case 900, the sliders 908A and 908B may slide along the strap 901, which may allow the computer 906 to exit the interior portion 914 of the case 900.

Extraction of the computer tray 904 may allow the computer 906 disposed within the computer tray 904 to be scanned by a scanning device (not shown). In addition, extraction of the tray 904 may allow the computer 906 to be visually inspected by scanning personnel. In some embodiments, the computer tray 904 may comprise a cover (not shown) to protect the computer 906 from scratching or other damage when extracted. The cover (not shown) may be comprised of materials configured to allow the computer 906 disposed within the tray 904 and/or under the cover (not shown) to be scanned by a scanning device, such as a TSA scanning device, X-ray device, or the like. In some embodiments, the cover (not shown) may be substantially transparent and/or see-through to allow for visual inspection and/or screening of the computer 906 by security personnel without removal of the cover.

Figure 10A:
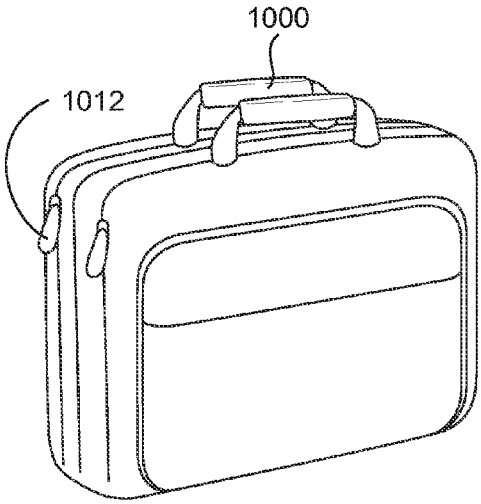
FIGS. 10A-E are views of one embodiment of a computer case.
Figure 10B:
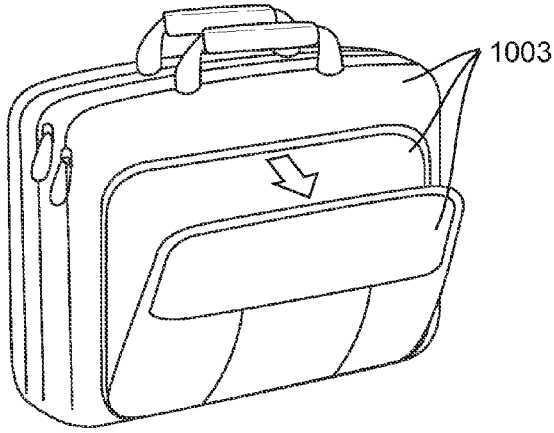
Figure 10C:
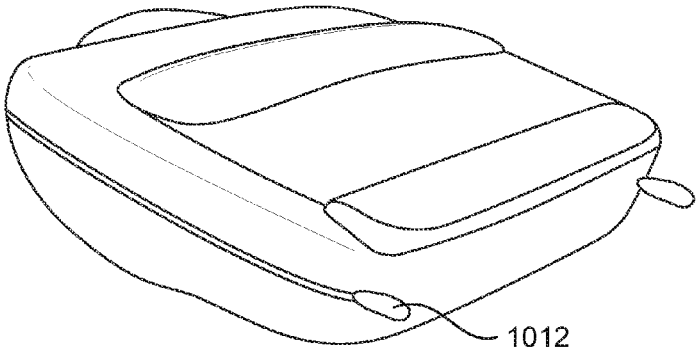
Figure 10D:
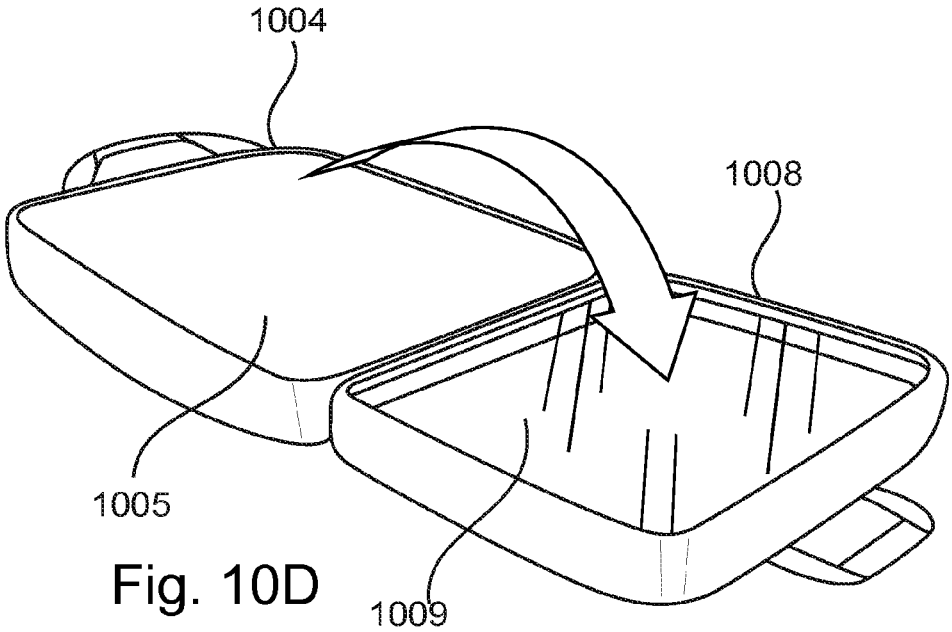

FIGS. 10A-D depict an embodiment of a case 1000 configured to allow a computer (not shown) stored therein to be quickly and conveniently scanned without removing the computer from the case 1000. As shown in FIG. 10D, the case 1000 comprises two foldably joined storage sections, a first storage section 1004 and a second storage section 1008. The first storage section 1004 may be pivotably and/or foldably joined to the second storage section 1008 by a deformable material, a hinge, straps, or the like. The case 1000 may be secured in a folded configuration by a fastener 1012 (the folded configuration of the case 1000 is shown in FIGS. 10A-C). The fastener 1012 may comprise any fastening means known in the art including, but not limited to: a buckle, a button, a pin, a strap, Velcro®, a zipper, or the like. In some embodiments, the fastener 1012 may further include a security device, such as a lock, a piezo alarm, a TSA approved luggage lock, or the like.

Figure 10E:
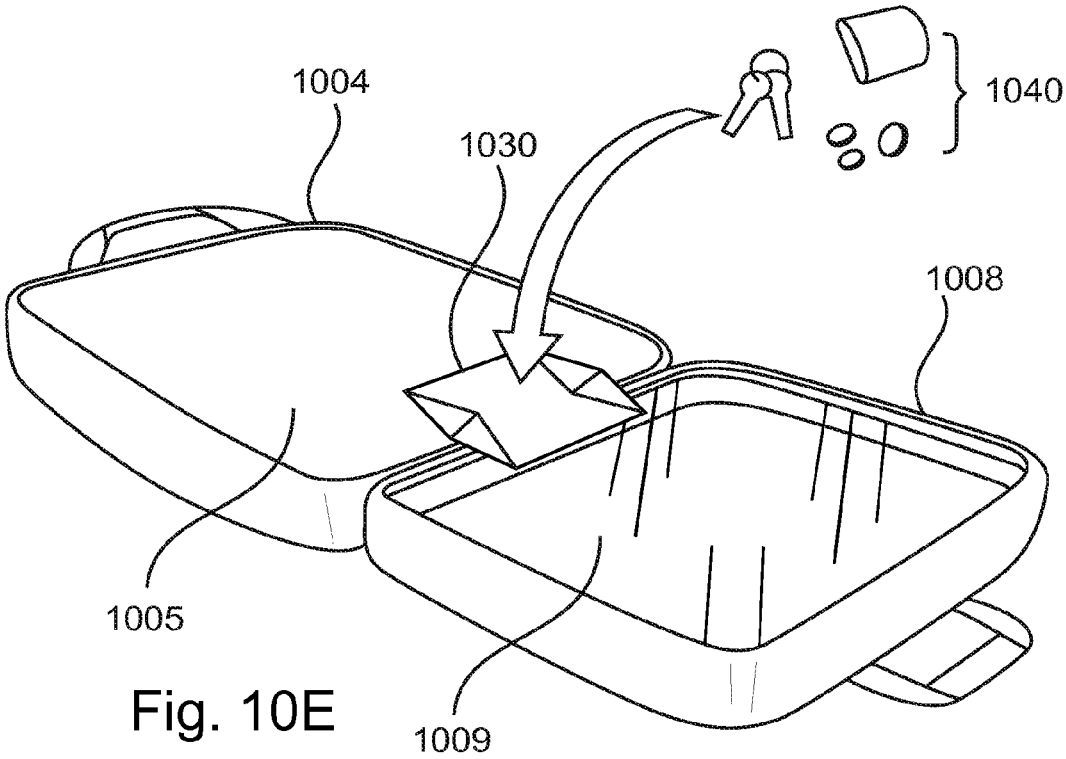

As shown in FIG. 10A-10E, the storage sections 1004 and 1008 may comprise a respective inner side and outer side. The outer sides of the storage sections 1004 and 1008 may be exposed when the case 1000 is in the closed, folded configuration (as shown in FIGS. 10A-10C). The inner sides 1005 and 1009 of the storage sections 1004 and 1008 may be exposed when the case 1000 is in the open, unfolded configuration (as shown in FIGS. 10D and 10E).

As will be discussed below, the second storage section 1008 may be adapted to receive a portable computer and the inner side 1009 of the second storage section 1009 may comprise a cover (e.g., the inner side 1009 may be a cover) to protect the computer from damage and/or loss during a screening process.

The fastener 1012 may be selectively releasable to allow the case 1000 to unfold into a flat, unfolded configuration (e.g., shown in FIGS. 10D and 10E). In the flat, unfolded configuration, the inner side 1005 of the first storage section 1004 and the inner side 1009 of the second storage section 1008 may be exposed.

The first storage section 1004 may be adapted to receive accessories and other items (e.g., a computer power supply, mouse, personal items, documents, and the like). The second storage section 1008 may be adapted to receive a portable computer (not shown), such as a laptop computer, a notebook computer, a tablet computer, or the like. The second storage section 1008 may comprise a cover 1009 to protect the computer (not shown) from loss and/or damage (e.g., scratching) when the case 1000 is in the unfolded configuration.

The cover 1009 may be comprised of materials configured to allow a computer (not shown) disposed within the second storage section 1008 to be scanned by a scanning device, such as a TSA scanning device, an X-ray scanner or the like. Accordingly, a computer within the second storage section 1008 may be scanned without removing the computer from the case 1000.

In some embodiments, the cover 1009 may be configured to allow a computer (not shown) disposed within the second storage section 1008 to be visible by screening personnel. This may allow the portable computer within the case 1000 to be visually inspected and/or screened. In these embodiments, the cover 1009 may be substantially transparent (e.g., may be comprised of a substantially transparent material, such as plastic, Lexan®, or the like), may be comprised of a mesh material (e.g., nylon mesh or the like), may be comprised of a sheer material, or the like.

In some embodiments, the cover 1009 may be removable to allow a computer (not shown) within the second storage section 1008 to be accessed, removed, and/or inserted. The cover 1009 may be secured to the second storage section 1008 via fastening means, such as a zipper, Velcro®, buttons, or any other fastening means known in the art.

When the case 1000 is placed in the flat, unfolded configuration shown in FIGS. 10D and 10E, the case 1000 may allow for scanning of a computer (not shown) disposed in the second storage section 1008 by a scanning device (not shown). In some embodiments, the cover 1009 comprising the inner side of the second storage section 1008 may allow the computer (not shown) to be visually scanned and/or inspected as part of a security screening process. After screening, the case 1000 may be returned to its folded configuration (e.g., shown in FIGS. 10A-10C), by folding the case 1000 and securing the fastener 1012. When in the folded configuration, the inner side 1005 of the first storage section 1004 may be approximated to the inner side 1009 of the second storage section 1008.

FIG. 10E shows another embodiment of the case 1000. In the FIG. 10E example, the case 1000 may comprise a foldable container (e.g., a pocket container) 1030 disposed between the first storage section 1004 and the second storage section 1008 of the case 1000.

When the case 1000 is in the folded configuration (e.g., as shown in FIGS. 10A-10C), the foldable container 1030 may be configured to fold between the first storage section 1004 and the second storage section 1008. Accordingly, the foldable container 1030 may comprise a pocket container, pouch, foldout tray, or other foldable container type. The foldable container 1030 may comprise deformable (e.g., foldable) edges interconnecting a plurality of panels. The deformable edges may allow the foldable container 1030 to transition from a folded configuration to an open, unfolded configuration as the case 1000 is folded and unfolded, respectively.

When the case 1000 is in the unfolded configuration, the foldable container 1030 may be configured to open, forming a container. In the open, unfolded configuration, the foldable container 1030 may be capable of receiving one or more personal items 1040, such as a wallet, keys, change, a cellular phone, a personal digital assistant (PDA), and the like. The foldable container 1030 may be comprised of materials configured to allow the personal items 1040 disposed therein to be scanned. Accordingly, the materials comprising the foldable container 1030 (as well as the second storage section 1008) may not interfere with the scanning device (not shown).

In other embodiments, the foldable container 1030 may comprise a container cover (not shown). The container cover may be adapted to secure the one or more personal items 1040 within the foldable container 1030 and/or prevent the loss of the personal items 1040 from the foldable container 1040. Accordingly, the foldable container 1030 may comprise means for securing the cover in place and/or means for securing the items 1040 within the foldable container 1030 including, but not limited to: a drawstring, a locking device, a piezo alarm, Velcro®, a zipper, or the like. The cover and/or securing means may prevent removal and/or loss of the items 1040 during the screening processes, while making the items available for security screening (e.g., scanning and/or visual inspection).

The cover (not shown) of the foldable container 1030 may be configured to allow the personal items 1040 to be scanned by a scanning device (e.g., using an X-ray scanner or the like). In some embodiments, the container cover may be configured to allow for visual scanning and/or inspection of the items 1040. As such, the foldable container 1030 and/or cover thereof may be comprised of substantially transparent materials (e.g., plastic, Lexan®, or the like), may be comprised of a mesh material (e.g., nylon mesh or the like), and/or may be comprised of sheer material, or the like.

Although FIG. 10E shows the foldable container 1030 disposed in a center portion of the case 1000, in other embodiments, the foldable container 1030 may be disposed proximally to one of the sides of the case 1000. When so disposed, the contents 1040 of the foldable container 1030 may be removed by tilting the case 1000 to the side. When tilted, the foldable container 1030 may be configured to allow the contents 1040 to slide out of the foldable container 1030 for easy removal.

FIGS. 11A-D depict another embodiment of a case 1100, which may be configured to allow a computer 1106 stored therein to be quickly and conveniently scanned without removal of the computer 1106.

The case 1100 may comprise two foldably joined sections, a first section 1104 and a second storage section 1108. The first section 1104 may be pivotably and/or foldably joined to the second storage section 1108 by a deformable material, a hinge, straps, or the like.

Figure 11A:
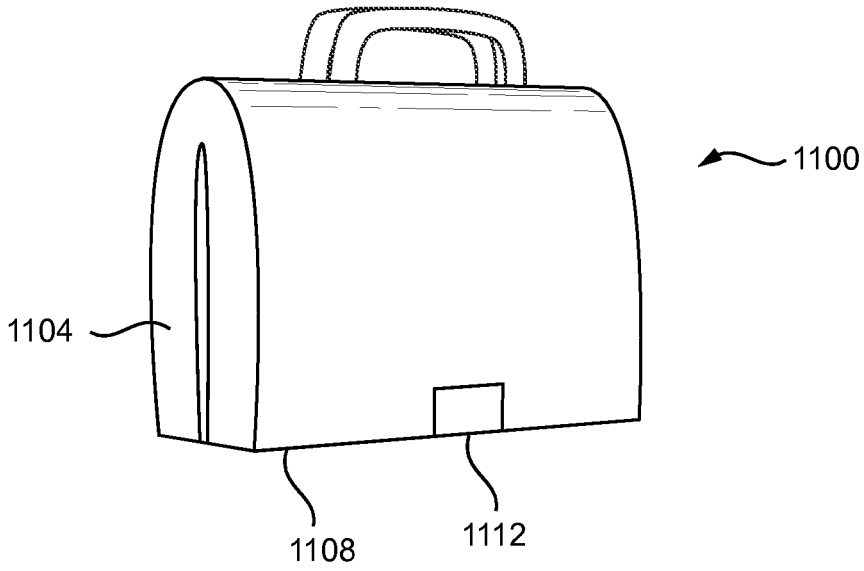
FIGS. 11A-D are views of one embodiment of a computer case.
Figure 11B:
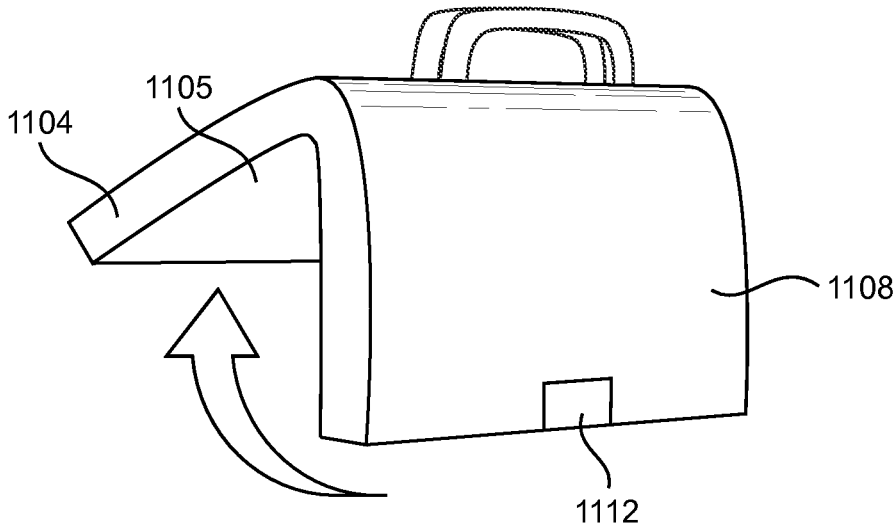
Figure 11C:
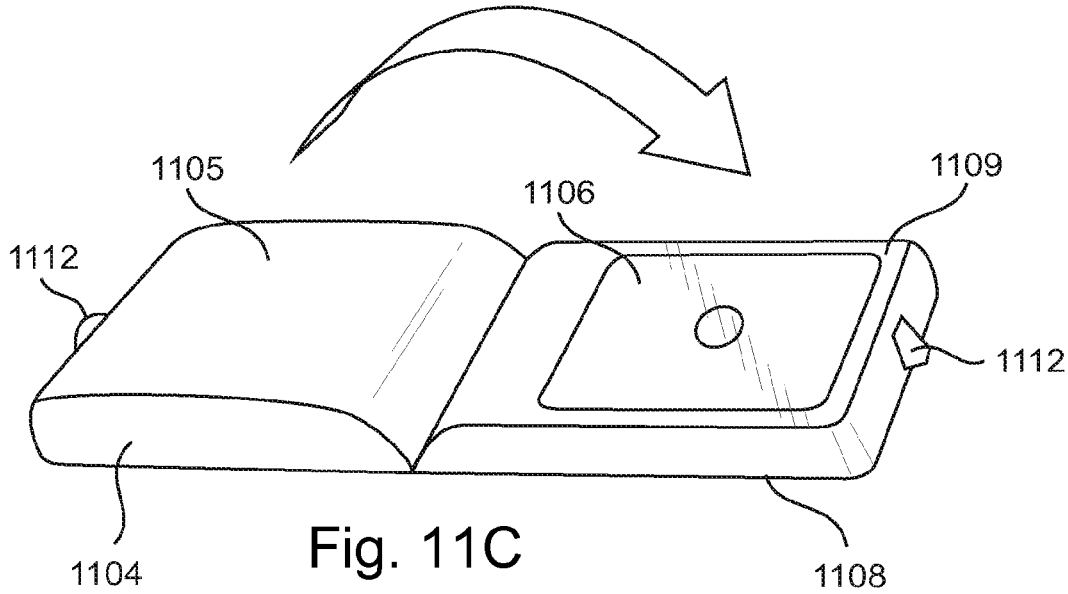
Figure 11D:
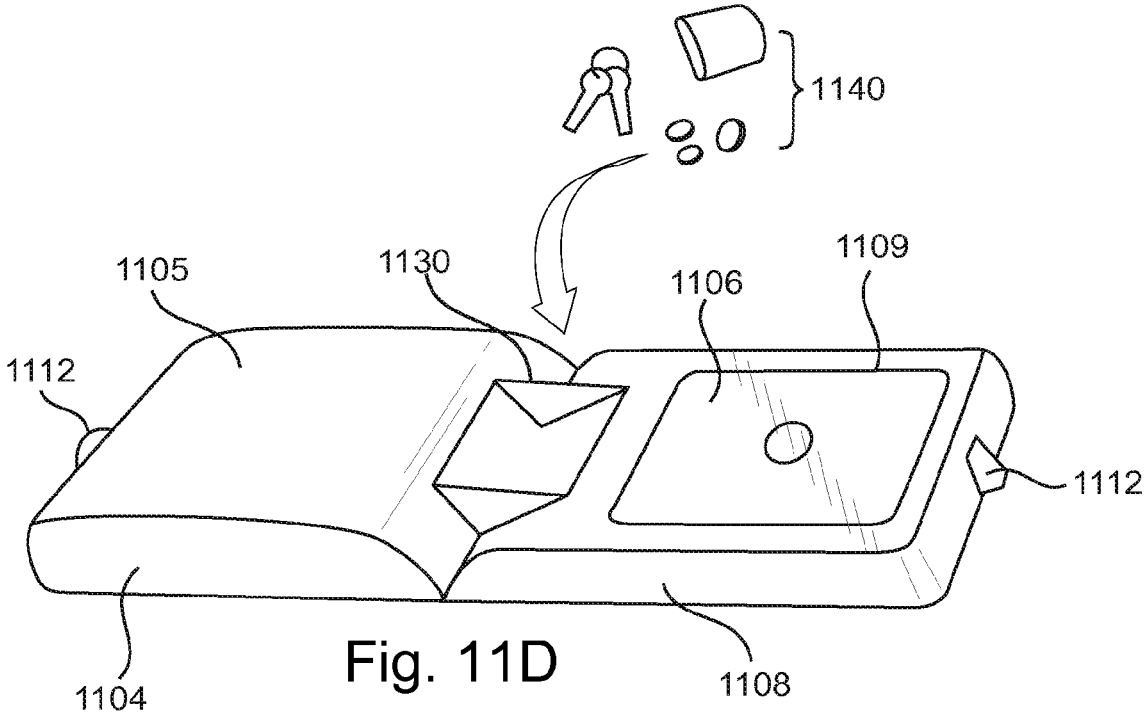

The case 1100 may have a folded configuration (as shown in FIG. 11A) and a flat, unfolded configuration (shown in FIGS. 11C and 11D). A fastener 1112 may secure the case 1100 in the folded configuration (e.g., as shown in FIG. 11A). The fastener 1112 may comprise any fastening means known in the art including, but not limited to: a buckle, a button, a pin, a strap, Velcro®, a zipper, or the like. In some embodiments, the fastener 1112 may further include a security device, such as a lock, a piezo alarm, a TSA approved luggage lock, or the like.

As shown in FIGS. 11A-11D, the first section 1104 and the second storage section 1108 may join at a top end of the case 1100 (e.g., proximate to the handle of the case). Accordingly, the case 1100 may transition from the folded configuration (shown in FIG. 11A) into the open, unfolded configuration (shown in FIGS. 11C and 11D), by releasing the fastener 1112 and unfolding the storage sections 1104 and 1108 from the bottom of the case 1100 as shown in FIG. 11B.

The first section 1104 may comprise an outer side and an inner side 1105. The second storage section 1108 may comprise an outer side and an inner side 1109. When the case is in the folded configuration, the inner side 1105 of the first section 1104 may be approximated to the inner side 1109 of the second storage section 1108.

The second storage section 1108 may be configured to receive a portable computer 1106. The inner side 1109 of the second storage section 1108 may comprise a cover, which may protect the computer 1106 from damage and/or loss during a screening process.

The cover 1109 may be adapted to allow the computer 1106 disposed in the case 1100 to be scanned by a scanning device (not shown) without removing the computer 1106 from the second storage section 1108 and/or without removal of the cover 1109. Accordingly, the cover 1109 (as well as the rest of the materials comprising the case 1100) may be comprised of materials configured to allow the computer 1106 and/or the other contents of the case 1100 to be scanned by a scanning device (e.g., the materials may be configured to avoid interfering with the operation of the scanning device).

As shown in FIGS. 11C and 11D, in some embodiments, the cover 1109 may be substantially transparent to allow the computer 1106 to be visually inspected and/or screened by screening personnel. In the embodiments of FIGS. 11C and 11D, the cover 1109 may be comprised of substantially transparent materials, such as plastic, Lexan®, or the like. In other embodiments, the cover 1109 may be comprised of a material in a mesh configuration. Alternatively, or in addition, the material comprising the cover 1109 may be sheer, to allow the computer 1106 to be viewed through the cover 1109.

FIG. 11D shows another embodiment of the case 1100. In the FIG. 11D example, the case 1100 comprises a foldable container (e.g., a pocket container) 1130 disposed between the first section 1104 and the second storage section 1108.

When the case 1100 is in the folded configuration (e.g., as shown in FIG. 11A), the foldable container 1130 may be configured to fold between the first section 1104 and the second storage section 1108. Accordingly, the foldable container 1130 may comprise a pocket container, pouch, foldout tray, or other foldable container type. The foldable container 1130 may comprise a plurality of panels connected by one or more deformable edges. The deformable edges may allow the foldable container 1130 to transition from a folded configuration to an open, unfolded configuration as the case 1100 is folded and unfolded, respectively.

When the case 1100 is in the open, unfolded configuration shown in FIG. 11D, the foldable container 1130 may be configured to open, forming a container. In the open, unfolded configuration, the foldable container 1130 may be capable of receiving one or more items 1140 (e.g., a wallet, keys, coins, a cellular telephone, PDA, or the like). The foldable container 1130 may be comprised of materials configured to allow the items 1140 disposed therein to be scanned by a scanning device (not shown). Accordingly, the materials comprising the foldable container 1130 (as well as the second storage section 1108) may be configured to avoid interfering with the operation of scanning devices (e.g., X-ray scanners and the like).

In other embodiments, the foldable container 1130 may comprise a container cover (not shown). The container cover may be adapted to secure the one or more items 1140 within the foldable container 1130 and/or prevent the loss of the items 1140. Accordingly, the foldable container 1130 may comprise means for securing the cover in place and/or means for securing the items 1140 within the foldable container 1130 including, but not limited to: a drawstring, a locking device, a piezo alarm, Velcro®, a zipper, or the like. The cover 1130 and/or securing means (not shown) may prevent removal and/or loss of the items 1140 during the screening processes, while making the items 1140 available for security screening (e.g., available for scanning by a scanning device and/or visual inspection).

The cover (not shown) of the foldable container 1130 may be configured to allow the personal items 1140 to be scanned by a scanning device (e.g., using an X-ray scanner or the like). In some embodiments, the container cover may be configured to allow for visual scanning and/or inspection of the items 1140. As such, the foldable container 1130 and/or cover thereof may be comprised of substantially transparent materials (e.g., plastic, Lexan®, or the like), may be comprised of a mesh material (e.g., nylon mesh or the like), and/or may be comprised of sheer material, or the like.

Although FIG. 11D shows the foldable container 1130 disposed in a center portion of the case 1100, in other embodiments, the foldable container 1130 may be disposed proximally to one of the sides of the case 1100. When so disposed, the items 1140 within the foldable container 1130 may be removed by tilting the case 1100 to a side. When so tilted, the foldable container 1130 may be configured to allow the items 1140 to slide out of the foldable container 1130 for easy removal.

FIGS. 12A-D depict another embodiment of a case 1200 configured to allow a computer 1206 stored therein to be quickly and conveniently scanned without removing the computer 1206. The case 1200 may comprise two foldably joined sections, a first section 1204 and a second storage section 1208. The first section 1204 may be pivotably and/or foldably joined to the second storage section 1208 by a deformable material, a hinge, straps, or the like.

Figure 12A:
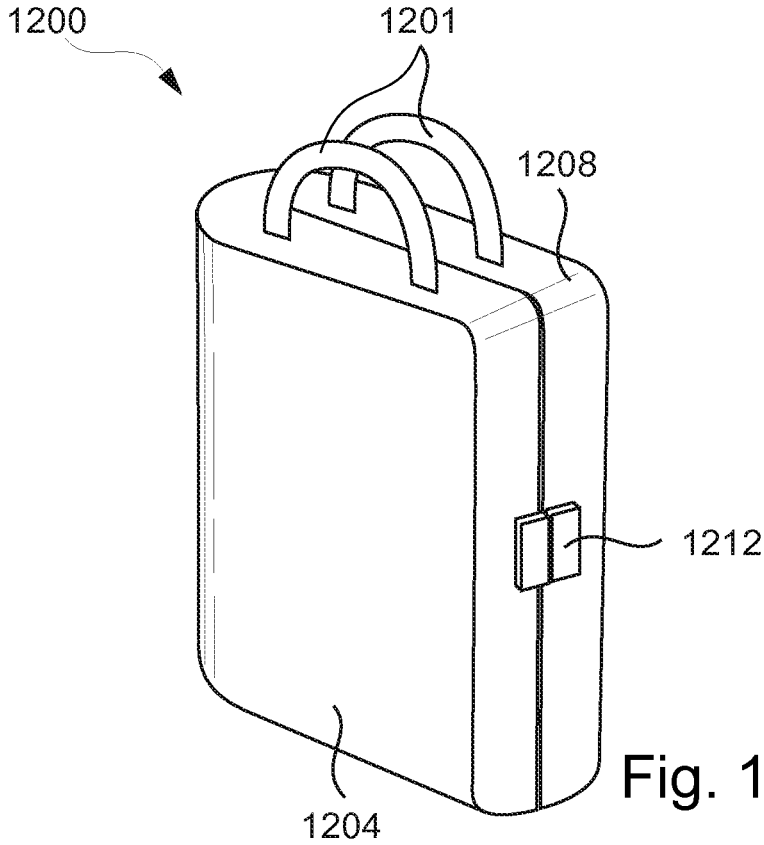
FIGS. 12A-D are views of one embodiment of a computer case.
Figure 12B:
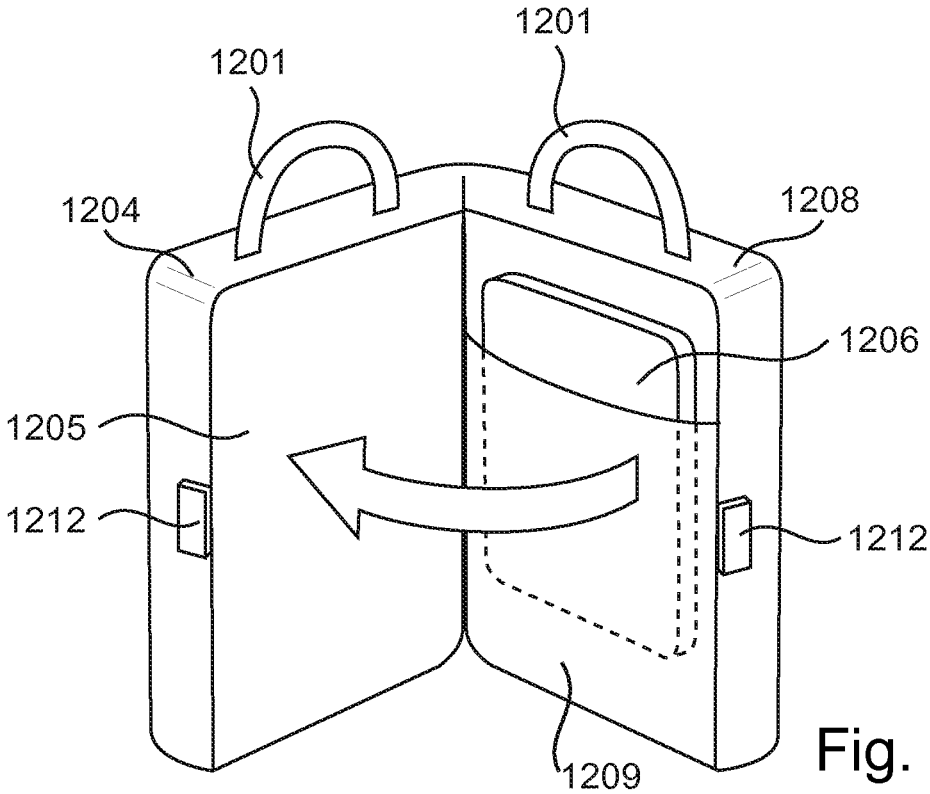
Figure 12C:
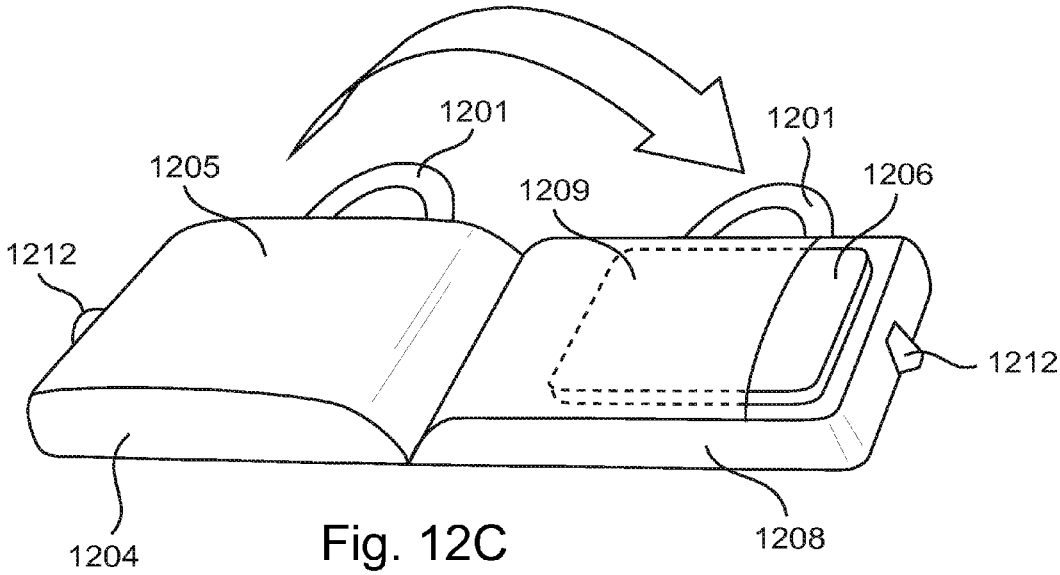
Figure 12D:
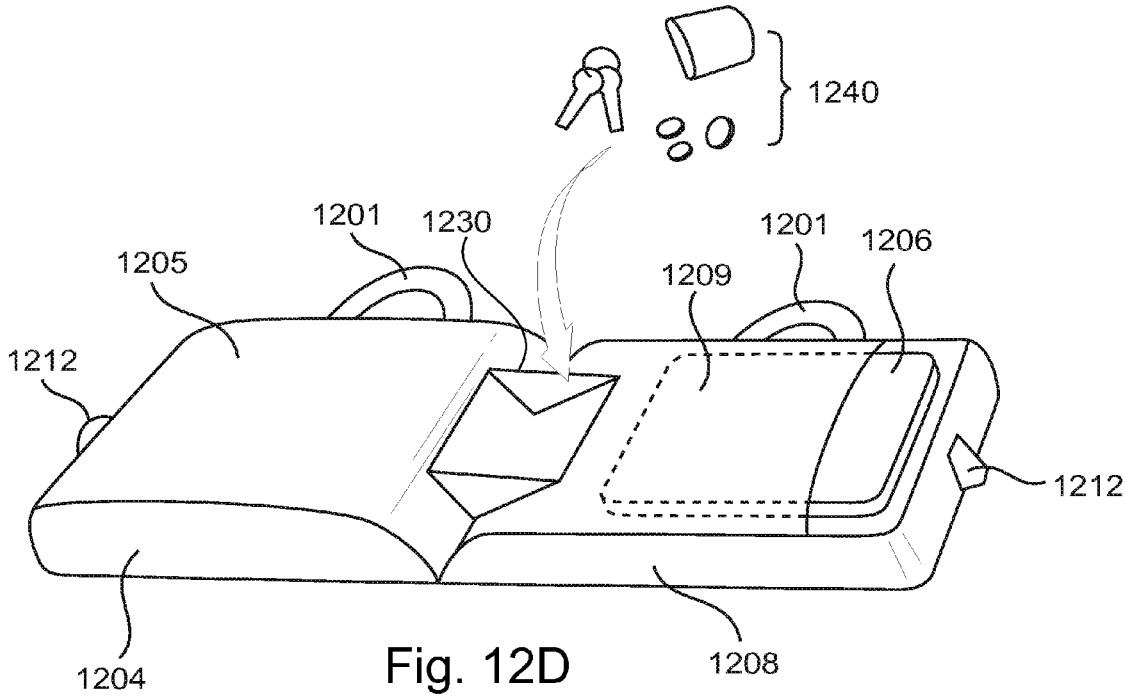

The case 1200 may have a folded configuration (as shown in FIG. 12A) and a flat, unfolded configuration (shown in FIGS. 12C and 12D). A fastener 1212 may secure the case 1200 in the folded configuration (e.g., as shown in FIG. 12A). The fastener 1212 may comprise any fastening means known in the art including, but not limited to: a buckle, a button, a pin, a strap, Velcro®, a zipper, or the like. In some embodiments, the fastener 1212 may further include a security device, such as a lock, a piezo alarm, a TSA approved luggage lock, or the like.

As shown in FIGS. 12A-12D, the first section 1204 and the second storage section 1208 may join at a side end of the case 1200. Accordingly, the case 1200 may transition from the folded configuration (shown in FIG. 12A) into the open, unfolded configuration (shown in FIGS. 12C and 12D), by laterally separating the storage sections 1204 and 1208 from a side of the case 1200 as shown in FIG. 12B. In some embodiments, a handle 1201 of the case 1200 may be separable (e.g., as shown in FIGS. 12B-12D, one portion of the handle 1201 may be disposed on the first section 1204 and another portion of the handle 1201 may be disposed on the second storage section 1208). The separable handle 1201 may be used to assist a user in opening the case 1200 (e.g., as shown in FIG. 12B).

The first section 1204 may comprise an outer side and an inner side 1205. The second storage section 1208 may comprise an outer side and an inner side 1209. When the case is in the folded configuration, the inner side 1205 of the first section 1204 may be approximated to the inner side 1209 of the second storage section 1208.

The second storage section 1208 may be configured to receive a portable computer 1206. The inner side 1209 of the second storage section 1208 may comprise a cover, which may protect the computer 1206 from damage and/or loss during a security screening processes.

The cover 1209 may be adapted to allow the computer 1206 disposed in the case 1200 to be scanned by a scanning device (not shown) without removing the computer 1206 from the second storage section 1208 and/or without removing the cover 1209. Accordingly, the cover 1209 (as well as the rest of the materials comprising the case 1200) may be comprised of materials configured to allow the computer 1206 and the other contents of the case 1200 to be scanned by a scanning device (e.g., the materials may be configured to avoid interfering with the operation of the scanning device).

In some embodiments, the cover 1209 may be substantially or partially transparent to allow a portion of the computer 1206 to be visually inspected and/or screened by screening personnel. For instance, the cover 1209 may comprised of transparent materials, such as plastic, Lexan®, or the like. In other embodiments, the cover 1209 may be comprised of materials in a mesh configuration. Alternatively, or in addition, the materials comprising the cover 1209 may be sheer, to allow the computer 1206 to be viewed through the cover 1209.

In the FIG. 12D embodiment, the cover 1209 may allow a portion of the computer 1206 to be seen. This may allow the visible portion of the computer 1206 to be visually inspected by screening personnel when the case 1200 is in the open, unfolded configuration even if the cover 1209 is comprised of non-transparent, opaque materials.

FIG. 12D shows another embodiment of the case 1200, comprising a foldable container 1230 (e.g., a pocket container) disposed between the first section 1204 and the second storage section 1208.

When the case 1200 is in the folded configuration (e.g., as shown in FIG. 12A), the foldable container 1230 may be configured to fold between the first section 1204 and the second storage section 1208. Accordingly, the foldable container 1230 may comprise a pocket container, pouch, foldout tray, or other foldable container type. The foldable container 1230 may comprise a plurality of panels interconnected by one or more deformable edges (e.g., foldable edges). The deformable edges may allow the foldable container 1230 to transition from a folded configuration to an open, unfolded configuration as the case 1200 is folded and unfolded, respectively. Alternatively, or in addition, the foldable container 1230 may be substantially comprised of deformable materials (e.g., a mesh container or the like). In this configuration, portions of the foldable container 1230 may be anchored to the inner side 1205 and/or 1209 of the first section 1204 and/or second storage section, respectively. Accordingly, when the case 1200 is placed in the open, unfolded configuration, the anchor points (not shown) of the foldable container 1230 may cause the foldable container 1230 to expand, opening to form the container shape depicted in FIG. 12D.

In the open, unfolded configuration, the foldable container 1230 may be capable of receiving one or more items 1240 (e.g., including a wallet, keys, coins, a cellular telephone, or the like). The foldable container 1230 may be comprised of materials configured to allow the items 1240 disposed therein to be scanned by a scanning device (not shown). Accordingly, the materials comprising the foldable container 1230 (as well as the second storage section 1208) may be configured to avoid interfering with the operation of scanning devices.

In some embodiments, the foldable container 1230 may comprise a container cover (not shown). The container cover may be adapted to secure the one or more items 1240 within the foldable container 1230 and/or prevent the loss of the items 1240 during screening. Accordingly, the foldable container 1230 may comprise means for securing the cover in place and/or means for securing the items 1240 within the foldable container 1230 including, but not limited to: a drawstring, a locking device, a piezo alarm, Velcro®, a zipper, or the like. The cover and/or securing means may prevent removal and/or loss of the items 1240 during the screening processes, while making the items available for security screening (e.g., scanning and/or visual inspection).

The cover (not shown) of the foldable container 1230 may be configured to allow the items 1240 to be scanned by a scanning device. (e.g., using an X-ray scanner or the like). In some embodiments, the container cover (not shown) may be configured to allow for visual scanning and/or inspection of the items 1240. As such, the foldable container 1230 and/or the cover thereof may be comprised of substantially transparent materials (e.g., plastic, Lexan®, or the like), may be comprised of a mesh material (e.g., nylon mesh or the like), and/or may be comprised of sheer material, or the like.

Although FIG. 12D shows the foldable container 1230 disposed in a center portion of the case 1200, in other embodiments, the foldable container 1230 may be disposed proximally to one of the sides of the case 1200. When so disposed, the items 1240 within the foldable container 1230 may be quickly removed by tilting the case 1200 to a side. When so tilted, the foldable container 1230 may be configured to allow the items 1240 to slide out of the foldable container 1230 for easy removal.

Figure 13A:
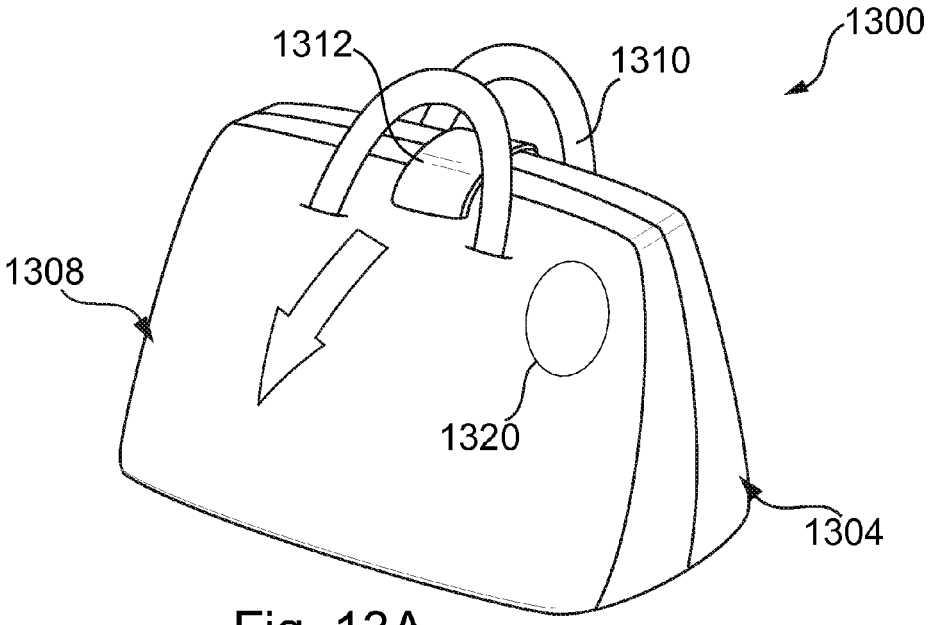
FIGS. 13A-B are views of one embodiment of a computer case.
Figure 13B:
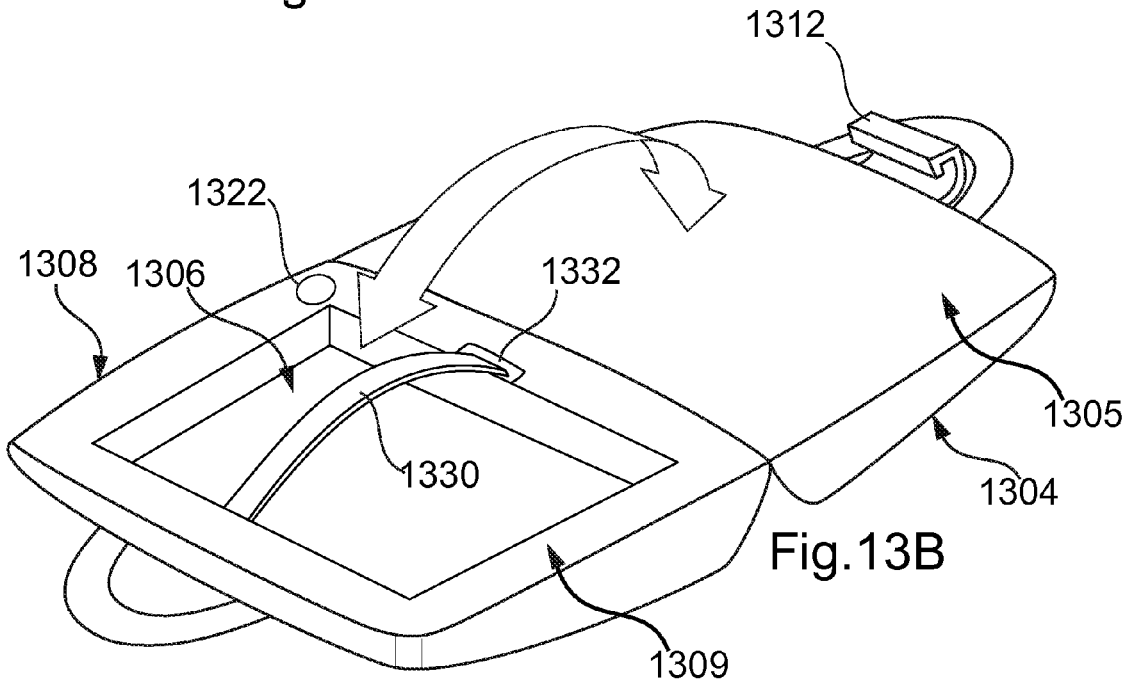

FIGS. 13A-B show another embodiment of a computer case 1300. The computer case 1300 comprises a first section 1304 and a second, computer storage section 1308. The first section 1304 and the second, computer storage section 1308 may be foldably (pivotably) joined, allowing the computer case 1300 to have a folded configuration (shown in FIG. 13A) and an open, unfolded configuration (shown in FIG. 13B). The first section 1304 and the second, computer storage section 1308 of the computer case 1300 may be foldably joined through use of a deformable material, a hinge, one or more straps, or the like.

A fastener 1312 may selectively maintain the computer case 1300 in the folded configuration shown in FIG. 13A. The fastener 1312 may comprise any fastening means known in the art including, but not limited to: a buckle, a button, a pin, a strap, Velcro®, a zipper, or the like. In some embodiments, the fastener 1312 may further include a security device, such as a lock, a piezo alarm, a TSA approved luggage lock, or the like.

The computer case 1300 may have a "clam-shell" type configuration. However, those of skill in the art will recognize that other case configurations could be used under the teachings of this disclosure. When in the closed configuration, the first storage section 1304 and the second, computer storage section 1308 are approximated as shown in FIG. 13A. As shown in FIG. 13B, when in the open, unfolded configuration, the first section 1304 and the second, computer storage section may be foldably (pivotably) separated, exposing an inner side 1305 of the first section and an inner side 1309 of the second, computer storage section 1308. Although FIGS. 13A-13B show the computer case 1300 pivoting from a top portion of the computer case 1300 (e.g., from a pivot point approximate to a handle of the computer case 1300), other pivot locations could be used under the teachings of this disclosure, such as a bottom pivot and/or a side pivot.

The computer case 1300 may comprise indicia 1320, which may be disposed on a portion of the computer case 1300. The indicia 1320 may be used to indicate that the computer case 1300 complies with a standard of a scanning authority (e.g., allows the contents of the computer case 1300 to be scanned by a scanning device (not shown) in use by the scanning authority). As shown in FIG. 13A, a portion of the indicia may be configured to be visible (e.g., visible to human scanning personnel). This may allow scanning personnel to use expedited scanning procedures on the computer case 1300.

In some embodiments, a portion of the indicia 1320 may not be immediately visible to the naked eye (e.g., may be embedded within the indicia 1320 and/or the computer case 1300). These portions of the indicia 1320 may be configured to be visible only through the use of a scanning device (e.g., an X-ray scanner). In some embodiments, the non-visible portions of the indicia 1320 may be used to verify and/or authenticate the authenticity of the indicia 1320.

FIG. 13B shows another example of an indicia 1322 on a computer case 1300. The indicia 1322 may be disposed on the inner side 1309 of the second, computer storage section 1308. The indicia 1322 may indicate that the computer case 1300 complies with a standard of a scanning authority. The indicia 1322 may comprise visible and non-visible portions. In some embodiments, the indicia 1322 may comprise a non-visible portion of the indicia 1320, since the indicia 1322 may not be visible by a human scanner without opening the computer case 1300 and/or without scanning the computer case 1300 using a scanning device.

As will be described below, the indicia 1320 and/or 1322 may comprise authentication means, such as a watermark, hologram, or other graphical information. These authentication means may allow a scanner to verify the authenticity of the indicia 1320 and/or 1322. In some embodiments, the indicia 1320 and/or 1322 may comprise means for communicating data with scanning personnel and/or computing equipment, such as a wireless transmitter, a data port (e.g., USB port, Firewire® port, or the like), a memory (e.g., a memory stick or other interface), interrogatable means, such as an Radio Frequency Identification (RFID) tag, or the like. The data transmitted from the indicia 1320 and/or 1322 may comprise authentication information, such as a password, PIN, credential, or the like. Similarly, the indicia 1320 and/or 1322 may comprise processing means (e.g., an embedded processor, an Application Specific Integrated Circuit (ASIC), a Field Programmable Gate Array (FPGA), or the like). The processing means may be configured to provide authentication information, such as providing a digital signature, providing information relating to an owner of the computer case 1300 (e.g., providing a photograph of the owner of the computer case 1300), providing security information relating to the owner of the case (e.g., an OpenID® of the computer case 1300 owner, CLEAR® expedited security enrollment information, or the like), and so on.

The computer case 1300 may be opened into the unfolded configuration by releasing the fastener 1312 as shown in FIG. 13B. The inner side 1309 of the second, computer storage section 1308 may comprise a recess 1306. The recess 1306 may be configured to receive a portable computer, such as a laptop (not shown). The portable computer may be secured within the recess 1306 using retention member 1330, such as a cover (not shown), a strap, or other selective retention means (e.g., a friction fit, a lip on the recess 1306, webbing, one or more cords, or the like). In the FIG. 13B embodiment, the retention member may comprise a releasable strap 1330, which may be configured to secure a portable computer within the recess 1330. The releasable strap 1330 may be selectively connected to the computer case 1300 using a strap fastener 1332, which may comprise any fastening means known in the art including, but not limited to: buckle, a button, a pin, a strap, Velcro®, a zipper, or the like. In alternative embodiments, the strap retention member 1330 may comprise two or more parts, which may be selectively joined to secure a computer within the recess 1306 (e.g., by Velcro®, a buckle, or the like).

The computer case 1300 may be comprised of materials configured to allow the computer (not shown) disposed within the recess 1306 to be scanned by a scanning device without removing the computer therefrom. In addition, the first section 1304 may be comprised of materials configured to allow the contents of the first section 1304 to be scanned by a scanning device without removing the items from the first section 1304.

The various embodiments of computer cases 100-1300 disclosed herein include a computer section that pivots, folds, rotates, slides, extends, or otherwise separates from other sections of the computer case. In the embodiments of FIGS. 1A-1C, 2, 4, 5A-B, 7A-7E, 10A-10E, and 13A-13B, the computer section may be characterized as pivoting, folding, or rotating away from the other sections of the computer case. In these embodiments, the cases may comprise a foldable storage section foldably and/or pivotably joined to the case and/or to other portions of the case (e.g., other storage sections of the like) by deformable material or fabric, a hinge, or other structure (e.g., straps or the like).

In the embodiments of FIGS. 1A-C and 2, the computer section may be characterized as a base section of the computer section. In the embodiment of FIG. 4, the portable computer may be characterized as folding out from a base portion of the computer case. In the embodiment of FIGS. 7A-E and 10A-E, the portable computer storage section may be characterized as folding and/or pivoting away from the case to expose an inner side of the computer storage portion.

In the FIGS. 3A-B, 8A-D, and 9A-C embodiments, the computer sections may be characterized as being slidably disposed with the respective cases 300, 800 and/or 900. In some embodiments, the computer sections and/or a computer disposed within the computer sections of the respective cases may be secured to the case using a security device, such as a lock, a piezo alarm, a TSA approved luggage lock, or the like. For example, in the embodiment of FIGS. 3A-3B, a portable computer is removed from a pouch 302, but remains connected to the pouch 302 via a retractable tether 310. However, other structures may be used in the cases 300, 800 and/or 900 to prevent the computer from being inadvertently separated from the case and/or stolen (e.g., a locking tether, security cable, or the like).

As described above, each of the cases 100-1300 shown and described in this disclosure may be comprised of materials capable of being scanned by TSA scanning devices (e.g., X-ray scanners or the like). As such, the materials comprising the cases 100-1300 may be configured to allow X-ray scanners (or other scanner types) to scan items disposed within the cases 100-1300. As such, the materials selected for use in the cases 100-1300 may be adapted to prevent interference with scanning devices, such as X-ray scanners and the like.

In other embodiments, the cases 100-1300 discussed above may be comprised of a combination of materials. Some of the materials may be configured to allow for scanning by TSA scanning devices, while other materials comprising the cases 100-1300 may not. In such embodiments, the materials comprising the portions of the cases 100-1300 adapted to receive a computer (e.g., the computer sleeves 804 and 904 of FIGS. 8A-8D and 9A-9C, the storage sections 708 and 1008 of FIGS. 7A-7E and 10A-10E, and so on), may be comprised of materials configured to allow for scanning by TSA scanning devices. However, other portions of the cases 100-1300 may not be configured to allow for scanning. For example, a case 100-1300 may comprise a shielded storage section, in which sensitive equipment may be stored. The shielded storage section may shield the contents therefrom from electromagnetic interference, which may prevent conventional scanning devices from penetrating the section. As will be discussed below, in such embodiments, the case 100-1300 may comprise indicia indicating which portions of the case 100-1300 are scannable, and which are not scannable.

In some of the embodiments disclosed herein, the computer case (e.g., cases 100-1300) may include an indicia showing that the case meets a security screening regulation, standard, and/or guideline, such as a TSA security screening standard. Alternatively, the indicia may show that the case is endorsed and/or approved by a particular scanning authority, such as the TSA. The indicia may visually indicate compliance with a particular standard and/or may transmit a signal indicative of such compliance (e.g., the indicia may comprise a Radio Frequency Identification (RFID) device capable of responding to radio frequency (RF) interrogation, a wireless transmitter, or the like).

The indicia may include a transmitter to wirelessly transmit information relating to the case 100-1300 and/or computer disposed within the case 100-1300 to a screener. The transmitter may be approved for use by the TSA or other screening authority and would be adapted to be compatible for interfacing with the equipment of the scanning authority. The transmitter may comprise a memory including an image of the scanned computer, identification information related to the computer and/or traveler in possession of the case 100-1300, and the like. Accordingly, the memory may comprise identification means and/or Clear® registration information for the traveler. The contents of the transmitter memory may be customized and/or updated by the traveler. The information may be transmitted from the case 100-1300 to screener equipment capable of receiving the transmitted data. The screening authority (e.g., TSA) may use the data to screen the passenger, verify traveler eligibility for expedited screening (e.g., under the Clear® program), verify the identity of the traveler (e.g., for check-in or other purposes), or the like. In addition, the transmitted information may comprise an image of a computer associated with the case 100-1300. The transmitted image may be compared to an image obtained by scanning the case 100-1300, which may allow a screener to determine whether a computer disposed within the case 100-1300 has been altered. The transmitter may be configured to transmit information using conventional techniques upon interrogation by another device (e.g., by a screening device). Alternatively, or in addition, the case 100-1300 may comprise input means to cause the transmitter to transmit the information (e.g., a button or other input means).

In one embodiment, the indicia may be comprised of materials that are primarily viewable only through use of electromagnetic screening devices, such as X-ray scanning devices. As such, the indicia may be hidden from the naked eye (e.g., disposed between panels of material and viewable through use of a screening device). Alternatively, or in addition, the indicia may be comprised of materials and/or marking means that are primarily visible only through the use of a scanning device (e.g., specially adapted ink, material pattern, or the like).

In some embodiments, the indicia may comprise a combination of visible and scannable indicia. This may allow screener personnel to properly handle the case 100-1300. The scannable portion of the indicia may only be observed through the use of a scanning device. The scannable indicia may be used to verify the visible portion of the indicia. For example, the visible and scannable portions of the indicia may refer to one another (e.g., the indicia portions may comprise a similar image, text information, PIN, or the like). The use of visible and scannable indicia may prevent the indicia from being counterfeit and/or may provide some level of verification of the visible indicia.

In some embodiments, the visual portion of the indicia may comprise a metal shape that is sewn within a panel, lining, or the like. The identifier may comprise a logo, symbol, or graphic that is easily viewed during screening. The identifier may be disposed in a location where it is likely to be viewed during screening. The scannable portion of the indicia may be disposed in another portion of the case 100-1300. The inspection of the scannable indicia may allow a screener to verify the visible indicia provided on the case 100-1300.

The various indicia embodiments discussed above may further include authentication means. The authentication means may allow a screening device (e.g., the screening device 750 of FIG. 7E) and/or screening personnel to verify that the case 100-1300 does in fact comply with a particular screening authority regulation, standard, and/or guideline as claimed by the indicia (e.g., verify that the case is compliant with and/or approved by the TSA or other security agency).

The authentication means may comprise a digital signature (e.g., a public key infrastructure (PKI) digital signature or the like) stored on a computer-readable media (e.g., an RFID tag, barcode, or the like), an image (e.g., a holographic image), a watermark, a password, a PIN, a challenge response, or any other authentication means known in the art. Accordingly, in some embodiments, the authentication means of the indicia may comprise static authentication information accessible via a screener and/or autonomously accessible via a screening device (e.g., as RFID information, a barcode, or the like).

Alternatively, or in addition, the authentication means of the indicia may comprise a smart card or similar device capable of producing and/or generating an authentication credential and/or of responding to an authentication challenge. In these embodiments, the authentication information may also serve to authenticate the traveler associated with the case 100-1300. The authentication information may be transmitted to a screening device and/or a screener using a wireless transmitter. Alternatively, or in addition, the authentication information may be made available via a specially adapted data transfer port within the case 100-1300, such as a Universal Serial Bus (USB) interface, an IEEE 1394 interface (Firewire), or the like.

The authentication information of the indicia may further include traveler identifying information. The traveler identifying information may be used to tie a particular traveler to a particular case 100-1300 to prevent the theft and/or unauthorized use of the case 100-1300. Similarly, the information may tie a particular computing device to a particular case 100-1300. Alternatively, or in addition, the authentication information may comprise Clear® registration information or other authenticating means to allow the traveler to access expedited security screening procedures.

As discussed above, some embodiments of the cases 100-1300 of this disclosure may comprise portions that are not configured to be scanned by security scanning devices (e.g., by an X-ray or other scanning device). For example, a portion of a case 100-1300 may be shielded to protect the contents thereof (e.g., to protect sensitive electronic devices, such as a camera, memory device, medial material, or the like). The portion of the case 100-1300 so shielded may be marked using a secondary indicia. The secondary indicia may indicate which portion(s) of the case 100-1300 cannot be scanned using conventional scanning equipment. As discussed above, portions of the secondary indicia may be visible (e.g., a tag, badge, alternative color, or the like), and/or portions of the secondary indicia may be visible only upon use of scanning equipment (e.g., the non-scannable portions of the case 100-1300 may appear to have a label, watermark, or other feature upon scanning). In embodiments including a transmitter or other communication means, the communication means may indicate which portions of the case 100-1300 are scannable and which are not.

It can be appreciated that the computer case may be embodied as a shoulder-strapped case, backpack, wheeled luggage, briefcase, and other case configurations. All such embodiments may include one or more of the features disclosed above. The embodiments disclosed herein provide convenient separation of a portable computer from other objects, devices, and the majority of a case to provide effective security screening. It is anticipated that the embodiments will meet with TSA approval and be recognized by TSA agents as complying with all federal requirements. In addition, it is anticipated the embodiments disclosed herein may meet with and/or be adapted to meet requirements of other screening authorities. It will be obvious to those having skill in the art that many changes may be made to the details of the above-described embodiments without departing from the underlying principles of the invention.

We claim:

1. A bi-fold case to allow for convenient security screening of a computer, comprising:

a first storage section comprising a first outer side, a first inner side, a first proximal end, and a first distal end opposite the first proximal end, the first outer side, first inner side, first proximal end, and first distal end defining a first pouch with a first pouch opening and a first pouch fastener coupled to the first pouch opening and configured to only secure the first pouch opening, wherein the first outer and inner sides are configured to enable a scanning device to scan through the first outer and inner sides and scan an interior of the first pouch, wherein the first storage section further comprises a third pouch including a third pouch opening, independent of the first pouch opening, and a third fastener to only secure the third pouch opening; and a second storage section comprising a second outer side, a second inner side having a surface area approximately equal to a surface area of the first inner side, a second proximal end, and a second distal end opposite the second proximal end, the second storage section comprising, a second pouch and the second storage section configured without an additional pouch, the second pouch configured to receive a computer, wherein the second storage section and the second outer and inner sides are configured to enable a scanning device to scan through the second outer and inner sides and scan an interior of the second pouch and a computer disposed therein, and a second pouch fastener configured to substantially enclose only the second pouch and thereby retain a computer therein, the second storage section foldably joined at the second proximal end to the first proximal end of the first storage section such that the second proximal end and the first proximal end are coupled adjacent one another to form a hinge configured to enable a scanning device to scan through the hinge, wherein the first and second inner sides are disposed adjacent one another in the folded configuration and separated in an unfolded configuration, wherein the first and second distal ends are disposed adjacent one another in the folded configuration and separated from one another in the unfolded configuration, wherein in the unfolded configuration with the outer sides of both the first and second storage sections laid flat upon a same planar surface, an object in the first storage section is removed from interfering with a scanner positioned above and below the second storage section to enable uninhibited scanning of a computer in the second pouch of the second storage section.

2. The case of claim 1, further comprising a fastener to selectively secure the first storage section and the second storage section in the folded configuration.

3. The case of claim 1, wherein the scanning device is an X-ray scanner.

4. The case of claim 1, wherein the inner side of the second pouch is configured to allow for visual inspection of a computer disposed within the second pouch of the second storage section when second storage section is in the unfolded configuration.

5. The case of claim 1, wherein the outer side of the second storage section is substantially opaque and the inner side of the second pouch comprises a substantially transparent material.

6. The case of claim 5, wherein the inner side of the second pouch comprises a mesh material.

7. The case of claim 1, further comprising a foldable container disposed between the first storage section and the second storage section.

8. The case of claim 7, wherein the foldable container is configured to fold between the first storage section and the second storage section when the second storage section is in the folded configuration, and wherein the foldable container is configured to open to form a container when the second storage section is in the unfolded configuration.

9. The case of claim 8, wherein the foldable container is configured to receive one or more personal items when the first storage section is in the unfolded configuration.

10. The case of claim 9, wherein the foldable container is configured to allow the one or more personal items disposed therein to be scanned by the scanning device.

11. The case of claim 9, wherein the foldable container is configured to allow the one or more personal items disposed therein to be visually inspected.

12. The case of claim 1, wherein the inner side of the first storage section comprises a pocket container, and wherein the pocket container is configured to receive one or more personal items and to allow the one or more personal items received therein to be scanned by a scanning device.

13. The case of claim 1, further comprising indicia indicating the case complies with a standard of a scanning authority.

14. The case of claim 13, wherein a portion of the indicia is visible.

15. The case of claim 13, wherein the indicia is embedded in the case and only visible through the use of a scanning device.

16. The case of claim 13, wherein the indicia comprises authentication means.

17. A bi-fold computer case to allow for convenient security screening of a computer disposed therein, the bi-fold computer case having a folded and an unfolded configuration, the bi-fold computer case comprising:

a first storage section comprising a first outer side, a first inner side, a first proximal end, and a first distal end opposite the first proximal end, the first outer side, first inner side, first proximal end, and first distal end defining a first pouch with a first pouch opening and a first pouch fastener coupled to the first pouch opening and configured to only secure the first pouch opening, wherein the first outer and inner sides are configured to enable a scanning device to scan through the first outer and inner sides and scan an interior of the first pouch, wherein the first storage section further comprises a third pouch coupled to the first outer side, the third pouch including a third pouch opening, independent of the first pouch opening, and a third fastener to only secure the third pouch opening;

a second storage section comprising a second outer side, a second inner side, a second proximal end, and a second distal end opposite the second proximal end, the second section comprising a second pouch configured to receive a computer, the second storage section configured without an additional pouch, wherein the second storage section and the second outer and inner sides are configured to enable a scanning device to scan through the second outer and inner sides and scan an interior of the second pouch and a computer disposed therein, the second storage section foldably joined at the second proximal end to the first proximal end of the first storage section such that the first and second proximal ends are coupled adjacent one another, the first and second proximal ends forming a hinge configured to enable a scanning device to scan through the hinge, wherein in the folded configuration, the first inner side is approximated to the second inner side, and wherein the first and second distal ends are disposed adjacent one another in the folded configuration and separated from one another in the unfolded configuration;

a fastener to selectively maintain the computer case in the folded configuration, wherein in the unfolded configuration with the outer sides of both the first and second storage sections laid flat upon a same planar surface, an object in the first storage section is removed from interfering with a scanner positioned above and below the second storage section to enable uninhibited scanning of a computer in the second pouch of the second storage section.

18. The bi-fold computer case of claim 17, wherein the scanning device is an X-ray scanner.

19. The bi-fold computer case of claim 17, wherein the second outer side of the second storage section is substantially opaque and the second inner side of the second storage section includes a substantially transparent material to allow a computer disposed within the second storage section to be visually inspected.

20. The bi-fold computer case of claim 17, further comprising a foldable container, wherein the foldable container is configured to fold between the first and second inner sides when the computer case is in the folded configuration and to open to form a container disposed between the first and second storage sections when the computer case is in the unfolded configuration, and wherein the foldable container is configured to receive one or more personal items when in the open configuration.

21. A bi-fold computer case to allow for convenient security screening of a computer and having a folded configuration and an unfolded configuration, the computer case comprising:

a first storage panel comprising a first inner side, a first outer side, a first proximal end, and a first distal end opposite the first proximal end, the first inner side, first outer side, first proximal end, and first distal end defining a first pouch, the first distal end having a first pouch opening, wherein the first outer and inner sides are configured to enable a scanning device to scan through the first outer and inner sides and scan an interior of the first pouch;

a second storage panel comprising a second inner side, a second outer side, second proximal end, a second distal end opposite the second proximal end, and a second pouch and the second storage panel configured without an additional pouch, the second pouch configured to receive a computer, the second distal end including a sidewall with a second pouch opening disposed substantially in the center of the sidewall, wherein the second storage panel and the second outer and inner sides are configured to enable a scanning device to scan through the second outer and inner sides and scan an interior of the second pouch and a computer disposed therein, the second storage panel foldably joined at the second proximal end to the first proximal end of the first storage panel such that the first and second proximal ends are coupled adjacent one another to form a hinge configured to enable a scanning device to scan through the hinge, wherein in the folded configuration of the foldable computer case, the inner side of the first storage panel is approximated to the inner side of the second storage panel, wherein the first and second distal ends are disposed adjacent one another in the folded configuration and separated from one another in the unfolded configuration;

a fastener to selectively maintain the bi-fold computer case in the folded configuration, wherein in the unfolded configuration with the outer sides of both the first and second storage panels laid flat upon a same planar surface, an object in the first storage panel is removed from interfering with a scanner positioned above and below the second storage panel to enable uninhibited scanning of a computer in the second pouch of the second storage panel, wherein the first pouch opening is disposed on the first storage panel and the second pouch opening is disposed on the second storage panel such that when the case is in the unfolded configuration with the outer sides of both the first and second storage panels laid flat upon the same planar surface, the first and second pouch openings are both oriented in a direction substantially parallel to the planar surface.

22. A bi-fold computer case, comprising:

a first section comprising a first inner side, a first outer side, a first proximal end, and a first distal end opposite the first proximal end, the first inner side, first outer side, first proximal end, and first distal end defining a first pouch, the first distal end including a first pouch opening, wherein the first outer and inner sides are configured to enable a scanning device to scan through the first outer and inner sides and scan an interior of the first pouch;

a second section comprising a second inner side having a surface area approximately equal to a surface area of the first inner side, a second outer side, a second proximal end, a second distal end opposite the second proximal end, a first sidewall coupled to the second inner side and the second outer side, a second sidewall extending substantially parallel to the first sidewall and coupled to the second inner side and the second outer side, a top wall disposed on the second distal end, a second pouch and the second section configured without an additional pouch, and a second pouch opening extending along the top wall and partially extending along the first and second sidewalls, the second pouch configured to receive a computer, wherein the second section and the second outer and inner sides are configured to enable a scanning device to scan through the second outer and inner sides and scan an interior of the second pouch and a computer disposed therein, the first proximal end of the first section foldably joined to the second proximal end of the second section such that the first and second proximal ends are coupled adjacent one another, to form a hinge configured to enable a scanning device to scan through the hinge, wherein in a folded configuration of the bi-fold computer case, the inner side of the first section is approximated to the inner side of the second section, wherein the first and second distal ends are disposed adjacent one another in the folded configuration and separated from one another in an unfolded configuration, wherein in the unfolded configuration with the outer sides of both the first and second sections laid flat upon a same planar surface, an object in the first section is removed from interfering with a scanner positioned above and below the second section to enable uninhibited scanning of a computer in the second pouch of the second section, wherein the first pouch opening is disposed on the first section and the second pouch opening is disposed on the second section such that when the case is in the unfolded configuration with the outer sides of both the first and second sections laid flat upon the same planar surface, the first and second pouch openings are both oriented in a direction substantially parallel to the planar surface.

23. The computer case of claim 22, further comprising indicia, non-unique to the computer case, wherein the indicia indicates that the computer case complies with a standard of a scanning authority.

24. The computer case of claim 23, wherein a portion of the indicia is visible to scanning personnel.

25. The computer case of claim 23, wherein the indicia is embedded in the case and is visible only through the use of a scanning device.

26. The computer case of claim 23, wherein the indicia comprises means for authenticating the indicia.

27. The computer case of claim 22, wherein the second storage section comprises a retention member configured to secure the computer within the second pouch.

28. A method for providing a bi-fold computer case, comprising:

providing a first storage section including a first inner side, a first outer side, a proximal end, and a first distal end opposite the first proximal end, the first inner side, first outer side, first proximal end, and first distal end defining a first pouch including a first pouch opening and a first fastener to secure the first pouch opening, wherein the first outer and inner sides are configured to enable a scanning device to scan through the first outer and inner sides and scan an interior of the first pouch;

providing a second storage section having a surface area approximately equal to a surface area of the first storage section and including a second inner side, a second outer side, a second proximal end, and a second distal end opposite the second proximal end, the second storage section comprising a second pouch, the second distal end including a sidewall with a second pouch opening disposed substantially in the center of the sidewall and the second storage section configured without an additional pouch, the second pouch configured to receive a computer, wherein the second storage section and the second outer and inner sides are configured to enable a scanning device to scan through the second outer and inner sides and scan an interior of the second pouch and a computer disposed therein;

foldably joining the first storage section to the second storage section at the first and second proximal ends to form a hinge configured to enable a scanning device to scan through the hinge such that the first and second proximal ends remain adjacent one another in both folded and unfolded configurations, wherein the second inner and outer sides are configured to allow the computer secured within the second pouch to be scanned by a scanning device without removing the computer from the second pouch, wherein in the folded configuration of the bi-fold computer case, the inner side of the first storage section is approximated to the inner side of the second storage section, wherein the first and second distal ends are disposed adjacent one another in the folded configuration and separated from one another in the unfolded configuration, wherein in the unfolded configuration with the outer sides of both the first and second storage sections laid flat upon a same planar surface, an object in the first storage section is removed from interfering with a scanner positioned above and below the second storage section to enable uninhibited scanning of a computer in the second pouch of the second storage section, wherein the first pouch opening is disposed on the first storage section and the second pouch opening is disposed on the second storage section such that when the case is in the unfolded configuration with the outer sides of both the first and second storage sections laid flat upon the same planar surface, the first and second pouch openings are both oriented in a direction substantially parallel to the planar surface.

29. The method of claim 28, further comprising attaching a fastener to the first storage section and to the second storage section, wherein the fastener is configured to selectively secure the first storage section and the second storage section in the folded configuration.

30. The method of claim 28, wherein the scanning device is an X-ray scanner.

31. The method of claim 28, wherein the second inner side is configured to allow for visual inspection of the computer disposed within the second storage section.

32. The method of claim 31, wherein the second outer side is opaque and the second inner side of the second pouch comprises a substantially transparent material.

33. The method of claim 32, wherein the second inner side is comprised of a mesh material.

34. The method of claim 28, further comprising attaching a foldable container to the first storage section and to the second storage section, wherein the foldable container is configured to fold between the first storage section and the second storage section when the first storage section and the second storage section are in the folded configuration, and wherein the foldable container is configured to open to form a container when the first storage section and the second storage section are in the unfolded configuration.

35. The method of claim 34, wherein the foldable container is configured to receive one or more personal items when the first storage section and the second storage section are in the unfolded configuration.

36. The method of claim 35, wherein the foldable container is configured to allow the one or more personal items disposed therein to be scanned by the scanning device.

37. The method of claim 35, wherein the foldable container is configured to allow the one or more personal items disposed therein to be visually inspected.

38. The method of claim 28, further comprising attaching indicia to the computer case, wherein the indicia is non-unique to the computer case and indicates that the computer case complies with a standard of a scanning authority.

39. The method of claim 38, wherein a portion of the indicia is visible.

40. The method of claim 38, wherein the indicia is embedded in the computer case and is only visible through the use of a scanning device.

41. The method of claim 38, further comprising including an authentication credential in the indicia.

42. A method for manufacturing a bi-fold computer case, comprising:

providing a first storage section including a first inner side, a first outer side, a proximal end, and a first distal end opposite the first proximal end, the first inner side, first outer side, first proximal end, and first distal end defining a first pouch including a first pouch opening and a first fastener to secure the first pouch opening, wherein the first outer and inner sides are configured to enable a scanning device to scan through the first outer and inner sides and scan an interior of the first pouch, wherein the first storage section further comprises a third pouch including a third pouch opening, independent of the first pouch opening, and a third fastener to only secure the third pouch opening;

providing a second storage section including a second inner side, a second outer side, a second proximal end, and a second distal end opposite the second proximal end, the second storage section comprising a second pouch and the second storage section configured without an additional pouch, the second pouch configured to receive a computer, wherein the second storage section and the second outer and inner sides are configured to enable a scanning device to scan through the second outer and inner sides and scan an interior of the second pouch and a computer disposed therein, foldably attaching the first proximal end of the first storage section to the second proximal end of the second storage section to form a hinge configured to enable a scanning device to scan through the hinge, wherein in a folded configuration of the bi-fold computer case, the inner side of the first storage section is approximated to the inner side of the second storage section, wherein the first and second distal ends are disposed adjacent one another in the folded configuration and separated from one another in an unfolded configuration, wherein in the unfolded configuration with the outer sides of both the first and second storage sections laid flat upon a same planar surface, an object in the first storage section is removed from interfering with a scanner positioned above and below the second storage section to enable uninhibited scanning of a computer in the second pouch of the second storage section.

43. The case of claim 1, wherein the case is configured as a backpack and further comprising first and second shoulder straps coupled to the first outer side of the first storage section, the first and second straps configured to receive a user's shoulders to support the case.

44. The case of claim 1, wherein the case is configured as a backpack and further comprising first and second shoulder straps coupled to the second outer side of the second storage section, the first and second straps configured to receive a user's shoulders to support the case.

45. The case of claim 1, further comprising a handle coupled to the hinge and configured to support the case.

46. The case of claim 1, further comprising:

a first handle coupled to the first distal end of the first storage section; and a second handle coupled to the second distal end of the second storage section, wherein in the folded configuration the first and second handles are disposed adjacent each other.

47. The case of claim 1, wherein the second storage section comprises:

a first cushion disposed on an interior side of the second pouch, and a second cushion disposed on an opposing interior side of the second pouch, the first and second cushions configured to enable a scanning device to scan through the first and second cushions.

48. The computer case of claim 21, wherein the first pouch opening and the second pouch opening are accessible to a user in the folded configuration.

49. The computer case of claim 21, wherein the first pouch opening and the second pouch opening are accessible to a user in the folded configuration.

50. A bi-fold case to allow for convenient security screening of a computer, comprising:

a first storage section comprising, a first outer side, a first inner side, a first proximal end, a first distal end opposite the first proximal end, a first pouch including a first opening and a first fastener, wherein the first outer and inner sides are configured to enable a scanning device to scan through the first outer and inner sides and scan an interior of the first pouch, and a third pouch coupled to the first outer side and including a third pouch opening independent of the first pouch opening and a third fastener to only secure the third pouch opening; and a second storage section comprising, a second outer side, a second inner side having a surface area approximately equal to a surface area of the first inner side, a second proximal end, and a second distal end opposite the second proximal end, the second storage section comprising, a second pouch including a second opening and coupled to the second inner side, and the second storage section configured without an additional pouch, the second pouch configured to receive a computer, wherein the second storage section and the second outer and inner sides are configured to enable a scanning device to scan through the second outer and inner sides and scan an interior of the second pouch and a computer disposed therein, and wherein the second storage section is foldably joined at the second proximal end to the first proximal end of the first storage section such that the second proximal end and the first proximal end are coupled adjacent one another to form a hinge configured to enable a scanning device to scan through the hinge, wherein the first inner side and the second pouch are disposed adjacent one another in the folded configuration and separated in an unfolded configuration, wherein the first and second distal ends are disposed adjacent one another in the folded configuration and separated from one another in the unfolded configuration, wherein in the unfolded configuration with the outer sides of both the first and second storage sections laid flat upon a same planar surface, an object in the first storage section is removed from interfering with a scanner positioned above and below the second storage section to enable uninhibited scanning of a computer in the second pouch of the second storage section.

51. The case of claim 50, wherein the second opening is disposed on the second storage section such that when the case is in the unfolded configuration with the outer sides of both the first and second storage sections laid flat upon the same planar surface, the second opening is oriented in a direction substantially parallel to the planar surface.

52. The case of claim 50, wherein the second pouch extends less than a length of the second inner side.

53. The case of claim 50, wherein the second storage section further includes a strap member extending over the second opening.

54. A bi-fold case to allow for convenient security screening of a computer, comprising:

a first storage section comprising, a first outer side, a first inner side, a first proximal end, a first distal end opposite the first proximal end, and a first pouch including a first opening and a first fastener, wherein the first outer and inner sides are configured to enable a scanning device to scan through the first outer and inner sides and scan an interior of the first pouch; and a second storage section comprising, a second outer side, a second inner side having a surface area approximately equal to a surface area of the first inner side, a second proximal end, and a second distal end opposite the second proximal end, the second storage section comprising, a second pouch including a second opening and coupled to the second inner side, and the second storage section configured without an additional pouch, the second pouch extending less than a length of the second inner side, the second pouch configured to receive a computer, wherein the second storage section and the second outer and inner sides are configured to enable a scanning device to scan through the second outer and inner sides and scan an interior of the second pouch and a computer disposed therein, and wherein the second storage section is foldably joined at the second proximal end to the first proximal end of the first storage section such that the second proximal end and the first proximal end are coupled adjacent one another to form a hinge configured to enable a scanning device to scan through the hinge, wherein the first inner side and the second pouch are disposed adjacent one another in the folded configuration and separated in an unfolded configuration, wherein the first and second distal ends are disposed adjacent one another in the folded configuration and separated from one another in the unfolded configuration, wherein in the unfolded configuration with the outer sides of both the first and second storage sections laid flat upon a same planar surface, an object in the first storage section is removed from interfering with a scanner positioned above and below the second storage section to enable uninhibited scanning of a computer in the second pouch of the second storage section.

55. The case of claim 54, wherein the second opening is disposed on the second storage section such that when the case is in the unfolded configuration with the outer sides of both the first and second storage sections laid flat upon the same planar surface, the second opening is oriented in a direction substantially parallel to the planar surface.

56. The case of claim 54, wherein the second storage section further includes a strap member extending over the second opening.

57. A bi-fold computer case to allow for convenient security screening of a computer and having a folded configuration and an unfolded configuration, the computer case comprising:

a first storage section comprising, a first inner side, a first outer side, a first proximal end, a first distal end opposite the first proximal end, a first pouch, and a first pouch opening disposed on the first distal end and in communication with the first pouch, wherein the first outer and inner sides are configured to enable a scanning device to scan through the first outer and inner sides and scan an interior of the first pouch;

a second storage section comprising, a second inner side, a second outer side, second proximal end, a second distal end opposite the second proximal end, a second pouch configured to receive a computer and the second storage panel configured without an additional pouch, and a second pouch opening at least partially disposed on the second distal end and in communication with the second pouch, wherein the second storage panel and the second outer and inner sides are configured to enable a scanning device to scan through the second outer and inner sides and scan an interior of the second pouch and a computer disposed therein, the second storage panel foldably joined at the second proximal end to the first proximal end of the first storage panel such that the first and second proximal ends are coupled adjacent one another to form a hinge configured to enable a scanning device to scan through the hinge, wherein the first and second distal ends are disposed adjacent one another in the folded configuration and separated from one another in the unfolded configuration, wherein in the folded configuration of the foldable computer case, the inner side of the first storage section is approximated to the inner side of the second storage section and the first pouch opening and the second pouch opening are configured to be accessible to a user, wherein in the unfolded configuration with the outer sides of both the first and second storage panels laid flat upon a same planar surface, an object in the first storage panel is removed from interfering with a scanner positioned above and below the second storage panel to enable uninhibited scanning of a computer in the second pouch of the second storage panel, wherein the first pouch opening is disposed on the first storage panel and the second pouch opening is disposed on the second storage panel such that when the case is in the unfolded configuration with the outer sides of both the first and second storage panels laid flat upon the same planar surface, the first and second pouch openings are both oriented in a direction substantially parallel to the planar surface.

* * * * *

(12) INTER PARTES REVIEW CERTIFICATE (3195th)

United States Patent
Cuong et al.

(10) Number: US 8,567,578 K1
(45) Certificate Issued: Jul. 26, 2023

(54) PORTABLE COMPUTER CASE

(75) Inventors: Bui Phu Cuong; Todd Gormick; Robert Shortt

(73) Assignee: TARGUS INTERNATIONAL LLC

Trial Number:

IPR2021-00371 filed Dec. 24, 2020

Inter Partes Review Certificate for:

Patent No.: 8,567,578
Issued: Oct. 29, 2013
Appl. No.: 12/370,824
Filed: Feb. 13, 2009

The results of IPR2021-00371 are reflected in this inter partes review certificate under 35 U.S.C. 318(b).

INTER PARTES REVIEW CERTIFICATE
U.S. Patent 8,567,578 K1
Trial No. IPR2021-00371
Certificate Issued Jul. 26, 2023

AS A RESULT OF THE INTER PARTES REVIEW PROCEEDING, IT HAS BEEN DETERMINED THAT:

Claims 1-6, 12-14, 17-19, 21-24, 27-33, 38-39 and 42-57 are found patentable.

* * * * *